US010654545B1

(12) United States Patent
Allen

(10) Patent No.: US 10,654,545 B1
(45) Date of Patent: May 19, 2020

(54) METHOD AND APPARATUS FOR MOVING A PLURALITY OF CARGO UNITS WITH CAVITIES

(71) Applicant: COASTAL CARGO COMPANY, L.L.C., New Orleans, LA (US)

(72) Inventor: Jeffrey B. Allen, Marritt Island, FL (US)

(73) Assignee: Coastal Cargo Company, L.L.C., New Orleans, LA (US)

( * ) Notice: Subject to any disclaimer, the term of this patent is extended or adjusted under 35 U.S.C. 154(b) by 62 days.

(21) Appl. No.: 16/131,136

(22) Filed: Sep. 14, 2018

Related U.S. Application Data

(60) Provisional application No. 62/558,591, filed on Sep. 14, 2017.

(51) Int. Cl.

| | |
|---|---|
| ***B66C 1/66*** | (2006.01) |
| ***B63B 27/10*** | (2006.01) |
| ***B66C 23/52*** | (2006.01) |
| ***B63B 27/30*** | (2006.01) |

(52) U.S. Cl.
CPC ..... *B63B 27/10* (2013.01); *B63B 27/30* (2013.01); *B66C 1/66* (2013.01); *B66C 23/52* (2013.01); *B66C 2700/0321* (2013.01)

(58) Field of Classification Search
CPC ..... B63B 27/10; B63B 27/30; B66C 1/66; B66C 23/52
USPC ..... 294/67.2, 67.21
See application file for complete search history.

(56) References Cited

U.S. PATENT DOCUMENTS

| | | | | | |
|---|---|---|---|---|---|
| 1,546,364 | A * | 7/1925 | Bennington | B66C 1/26 | 212/331 |
| 1,742,384 | A * | 1/1930 | Fitzgerald, Jr. | B66C 1/26 | 294/63.1 |
| 3,574,383 | A * | 4/1971 | Frater | A01D 87/0053 | 294/67.2 |
| 3,897,097 | A * | 7/1975 | Davis, Jr. | B66C 1/24 | 294/81.5 |
| 4,139,179 | A * | 2/1979 | Kukulski | B21C 47/24 | 294/67.2 |
| RE32,532 | E * | 10/1987 | Sonerud | F16L 1/065 | 414/745.4 |
| 4,722,106 | A * | 2/1988 | Scegiel | A01K 55/00 | 294/67.2 |
| 4,784,419 | A * | 11/1988 | Jensen | B66C 1/24 | 294/103.2 |
| 4,955,972 | A * | 9/1990 | LaBounty | B66C 3/00 | 294/67.2 |
| 5,688,009 | A * | 11/1997 | Pienta | B21C 47/24 | 294/67.2 |
| 6,081,573 | A * | 6/2000 | Akimoto | B66C 1/10 | 376/254 |
| 6,174,125 | B1 * | 1/2001 | Davis | B66F 9/185 | 294/93 |
| 6,502,878 | B1 * | 1/2003 | Peters | B66F 9/12 | 294/67.2 |

* cited by examiner

*Primary Examiner* — Paul T Chin
(74) *Attorney, Agent, or Firm* — Roy Kiesel Ford Doody & North, APLC; Brett A. North

(57) ABSTRACT

Disclosed is a method and apparatus for transferring cargo having a cavity therein, the system comprising: (a) a lifter suspended in free floating form by a crane; (b) the lifter having a frame and at least one lifting arm which is detachably connected to the frame; and wherein the frame has at least one lifting connector for detachably connecting the lifter to the crane.

20 Claims, 15 Drawing Sheets

METHOD AND APPARATUS FOR MOVING A PLURALITY OF CARGO UNITS WITH CAVITIES

CROSS-REFERENCE TO RELATED APPLICATIONS

This is a non-provisional of U.S. Provisional Patent Application Ser. No. 62/558,591 filed Sep. 14, 2017, which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Various embodiments relate to a method and apparatus for transferring cargo having a cavity therein, the system comprising: (a) a lifter/lifting device suspended in free floating form by a crane; (b) the lifter having a frame and at least one lifting arm/prong which is detachably connected to the frame; and (c) wherein the frame has at least one lifting connector for detachably connecting the lifter to the crane.

More particularly, various embodiments relate to an improved method and apparatus wherein at least one of the lifting arms has a first/front/free end for engaging the cargo by penetrating the cargo cavity, and a second/rear/attached end which is detachably connected to the frame; and wherein the lifter, when suspended by the crane, is configured such that the free end of at least one lifting arm is elevated higher than the attached end of the at least one lifting arm.

Using prior art sling methods to move multiple units of cargo can be slow and/or dangerous. Various embodiments of the method and apparatus can significantly increase the production speed and safety of loading and/or unloading cargo (e.g., in some cases doubling production speeds). In various embodiments the method and apparatus helps protect the integrity of the cargo being moved/transferred compared to the prior sling method which has the cargo units moving relative to each other and at different angles to each other during transfer (see e.g., FIG. 4 showing an example of multiple cargo units 2000 shifting relative to each other during movement which shifting can damage the cargo).

BRIEF SUMMARY

In one embodiment is provided a system for transferring cargo having a cavity therein, the system comprising: (a) a lifter/lifting device suspended by a crane; (b) the lifter having a frame and at least one lifting arm which is detachably connected to the frame; and (c) wherein the frame has at least one lifting connector for detachably connecting the lifter to the crane.

In one embodiment at least one of the lifting arms has a free end for engaging the cargo by penetrating the cargo cavity, and an attached end which is detachably connected to the frame; and wherein the lifter, when suspended by the crane, is configured such that the free end of at least one lifting arm is elevated higher than the attached end of the at least one lifting arm.

In various embodiments is provided a method of moving a plurality of cargo units, each of the cargo units having at least one cavity, comprising the steps of:

(a) providing a lifter, the lifter including:

(i) a frame with first/front and second/rear ends, right and left sides, and top and bottom portions; and (ii) at least one lifting arm/prong having spaced apart first/front and second/rear ends, wherein the second/rear end of the lifting arm is detachably connected to the frame at the second/rear end of the frame;

(b) moving the lifter to a position immediately adjacent to the plurality of units of cargo;

(c) causing each first/free end of the at least one lifting arm to penetrate the at least one cavity of the at least one cargo unit of the plurality of units of cargo;

(d) while the first/free end of each of the at least one lifting arm has penetrated the at least one cavity of the at least one cargo unit of the plurality of units of cargo, a crane raising the at least one cargo unit of the plurality of units of cargo to an elevated position;

(e) after step "d", while the free end of each of the at least one lifting arm has penetrated at least one cavity of the at least one cargo unit of the plurality of units of cargo, the crane moving the lifter and the at least one cargo unit of the plurality of units of cargo to a second position, which second position is spaced apart from its position in step "b", wherein during this step "e" the free end of each of the at least one lifting arm is elevated compared to the second end of each of the at least one lifting arm;

(f) after step "e," the crane depositing the at least one cargo unit of the plurality of units of cargo at the second position by lowering the lifter/lifting device, and (g) after the lowering of the lifter, the free end of each of the at least one lifting arm being withdrawn from the at least one cavity of each of the at least one cargo unit of the plurality of cargo units.

In various embodiments during step "e" wherein during this step "e", the free end of each of the at least one lifting arm is elevated compared to the second end of each of the at least one lifting arm such that the longitudinal axis of at least one of the at least one lifting arm forms an angle of inclination relative to a generally horizontal plane which is greater than 5 degrees. In various embodiments the angle of inclination can be greater than 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, or 89 degrees. In various embodiments the angle of inclination can fall within a range of between any two of the above specified degree measurements for a minimum angle of inclination.

In various embodiments, during steps "b", "c", "d", and/or "e", the crane can cause the angle of inclination to increase. In various embodiments the increase in the angle of inclination during steps "b", "c", "d", and/or "e" can be greater than 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, or 90 degrees. In various embodiments the increase in the angle of inclination during steps "b", "c", "d", and/or "e" can fall within a range of between any two of the above specified degree measurements for an increase in the angle of inclination.

In various embodiments, during steps "b", "c", "d", and/or "e", the angle of inclination can decrease due the lifter/lifting unit lifting the at least one cargo unit of the plurality of units of cargo. In various embodiments the decrease in the angle of inclination during steps "b", "c", "d", and/or "e" from lifting the at least one cargo unit of the plurality of units of cargo can be at least 1, 2, 3, 4, 5, 6, 7, 8, 9, 10, 11, 12, 13, 14, and/or 15 degrees. In various embodiments the decrease in the angle of inclination during steps "b", "c", "d", and/or "e" from lifting the at least one cargo unit of the plurality of units of cargo can fall within a range of between any two of the above specified degree measurements for a decrease in the angle of inclination.

In various embodiments a plurality of lifting arms can be provided with first/front and second/rear ends, wherein each of the plurality of lifting arms can be detachably connectable to the lifter at their second/rear ends. In various embodiments each of the plurality of lifting arms can be substantially of the same length. In various embodiments, the plurality of lifting arms can be of different lengths. In various embodiments the ratio of lengths between the shortest of the plurality of lifting arms to the longest of the plurality of lifting arms can be about 0.25, 0.3, 0.4, 0.5, 0.6, 0.7, 0.75, 0.8, 0.9, 1.0. In various embodiments the ratio of lengths between the shortest of the plurality of lifting arms to the longest of the plurality of lifting arms can fall within a range of between any two of the above specified ratios.

In various embodiments the detachable connection of the at least one lifting arm to the lifter can comprise a pin connector. In various embodiments the detachable connection can comprise a set screw connector.

In various embodiments the quantity of the at least one lifting arm detachably connected to the lifting device is selectable by a user. In various embodiments the quantity of the at least one lifting arm detachably connected to the lifting device selectable by a user is at least 1, 2, 3, 4, 5, 6, 7, 8, 9, 10, 11, 12, 13, 14, or 15. In various embodiments the quantity of the at least one lifting arm detachably connected to the lifting device selectable by a user can fall within a range of between any two of the above specified quantities.

In various embodiments, the cargo lifted by the at least one lifting arm, is forced/tends to move away from the first/free end of the at least one lifting arm to the spaced apart second/rear end of the at least one lifting arm, by the combination of the angle of inclination of the at least one lifting arm and gravity.

In various embodiments, during the process of moving a set of a plurality of cargo units (such as coiled wires from a vessel's hull) where a crane uses a lifter/lifting unit and multiple lifting and depositing steps, the lifter/lifting unit having a first quantity of lifting arms/prongs has its quantity of lifting arms/prongs selectively changed by a user to a second quantity or number which is different than the first quantity or number. After the selective change to the second quantity of lifting arms/prongs, the crane causes the lifter/lifter unit to in quantity additional multiple lifting and depositing steps and a crane causes the lifting unit/lifter to engage in multiple lifting and depositing steps to move an additional plurality of cargo units (such as coiled wires) from the vessel's hull.

In various embodiments different types of cranes can be used with the method and apparatus, such as a vessel's crane, a shore crane, and/or a floating crane. In various embodiments multiple cranes and multiple lifting devices can be used simultaneously.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
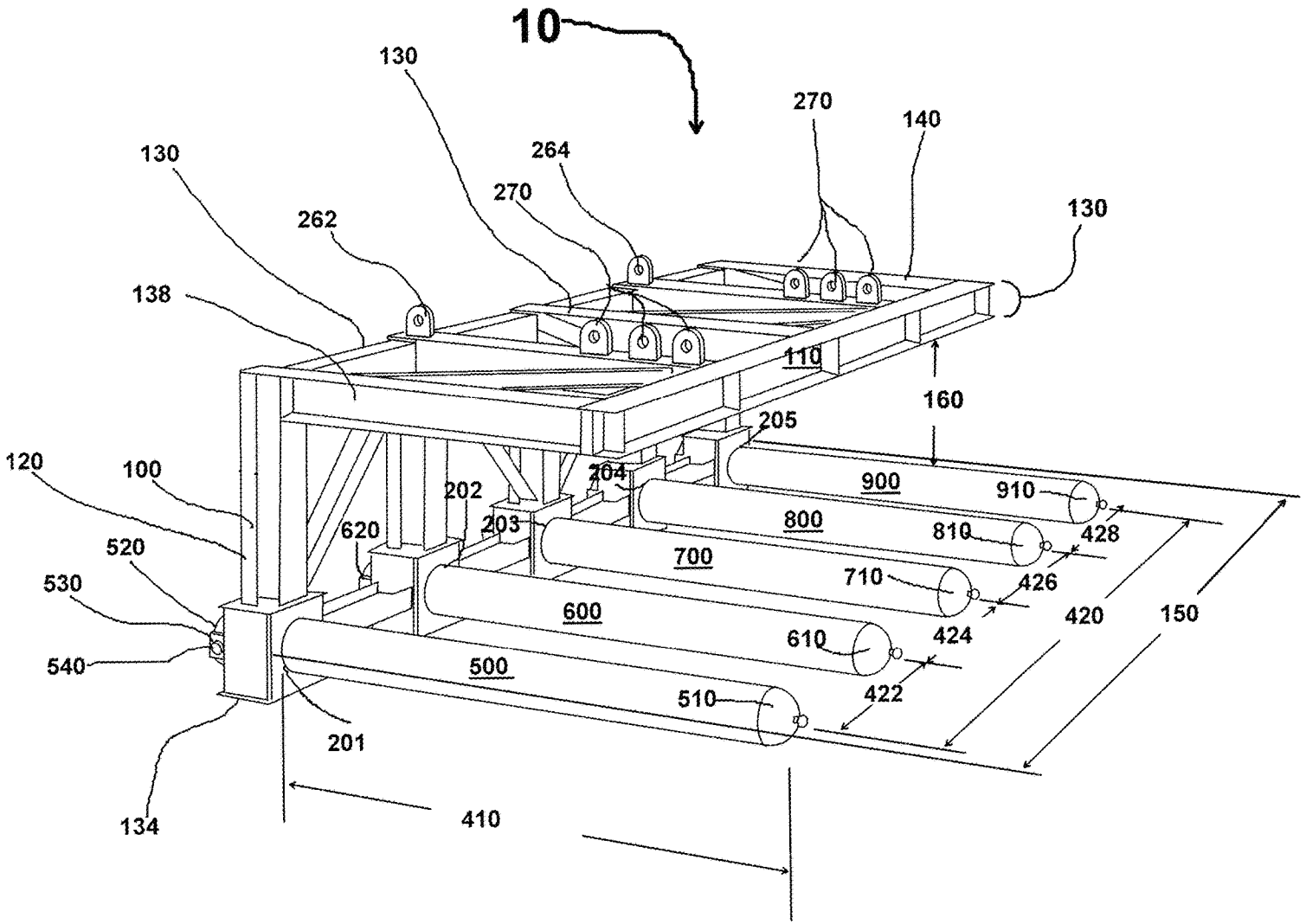
FIG. 1 is a left side perspective of one embodiment of a lifter/lifting device.
Figure 2:
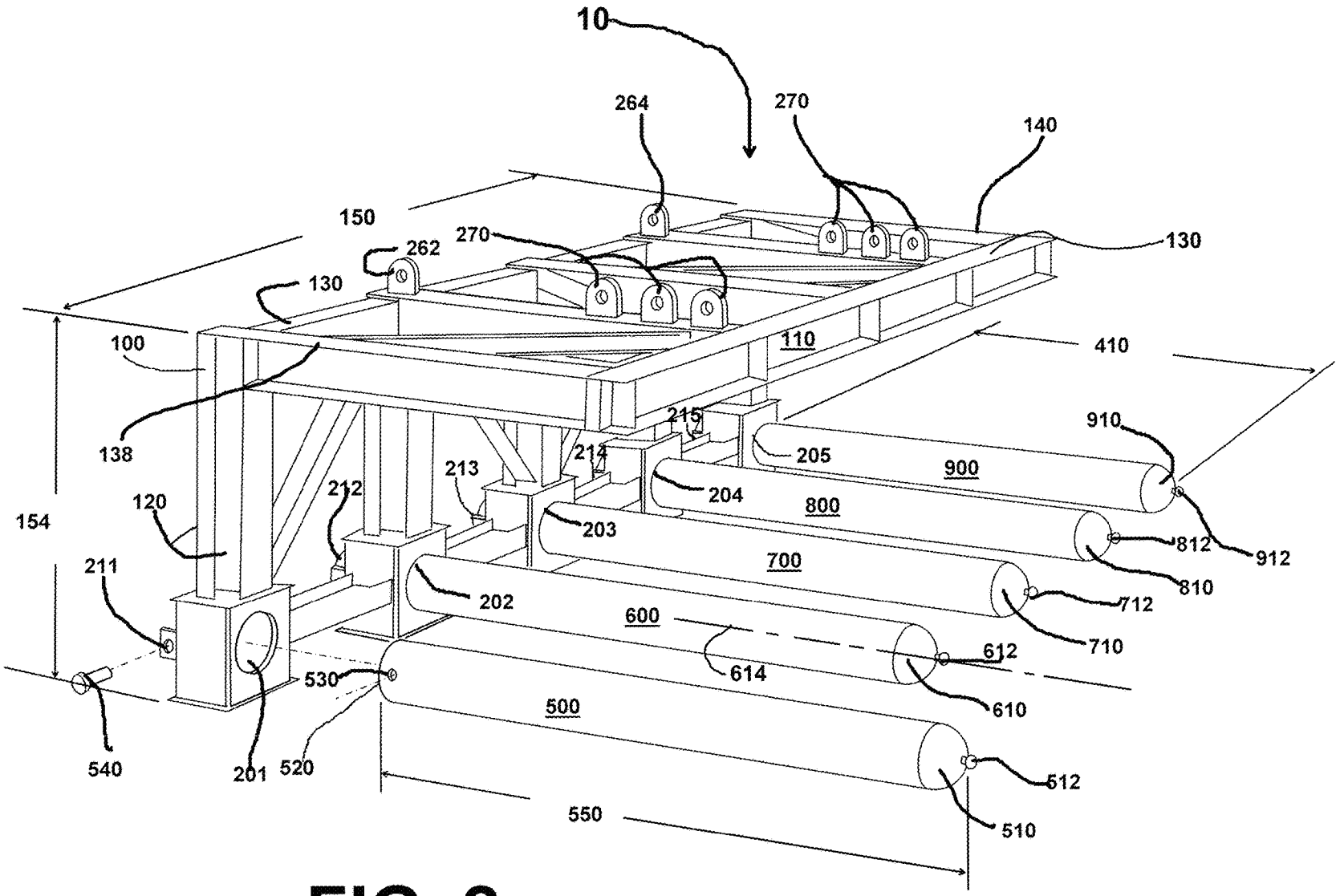
FIG. 2 is a side perspective of the lifting device of FIG. 1, but schematically showing that each of the lifting arm/prongs are detachably connectable to the lifting device, with only one lifting arm/prong being shown as detached for purposes of illustration.

FIG. 1 is a left side perspective of one embodiment of a lifter/lifting device 10. Generally, lifting device 10 can comprise a frame 100 and a plurality of lifting arms (e.g., arms 500, 600, 700, 800, and/or 900). FIG. 2 is a left side perspective of the lifting device 100, but schematically showing that each of the lifting arms/prongs 500,600,700, 800,900 are detachably connectable to the lifting device 10, with only one lifting prong 500 shown as detached.

Figure 3A:
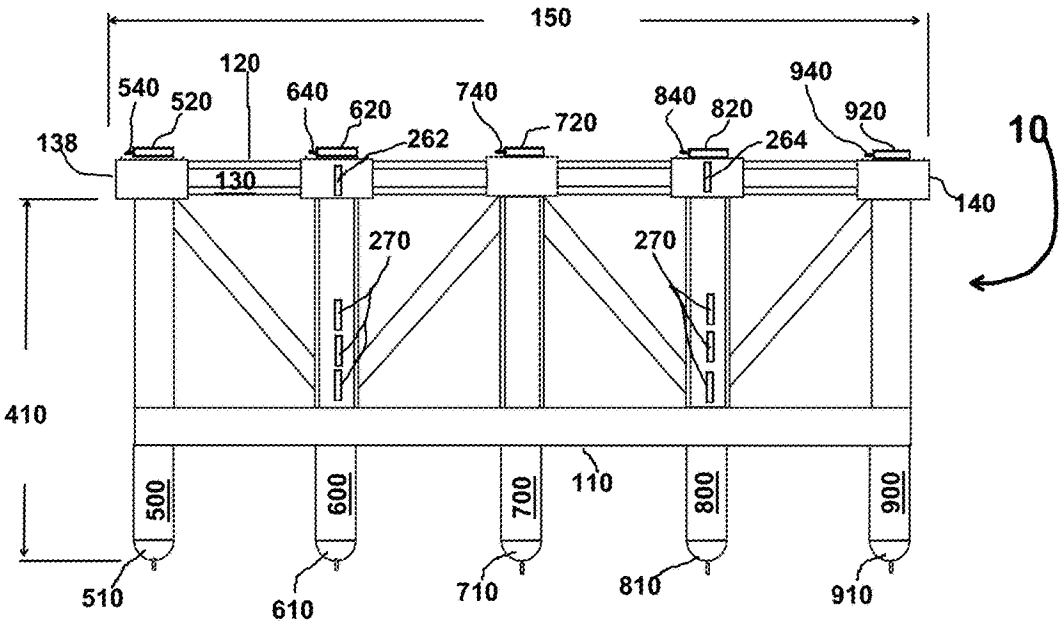
FIGS. 3A, 3B, and 3C, respectively, are top, right side, and front views of the lifting device of FIG. 1.
Figure 3C:
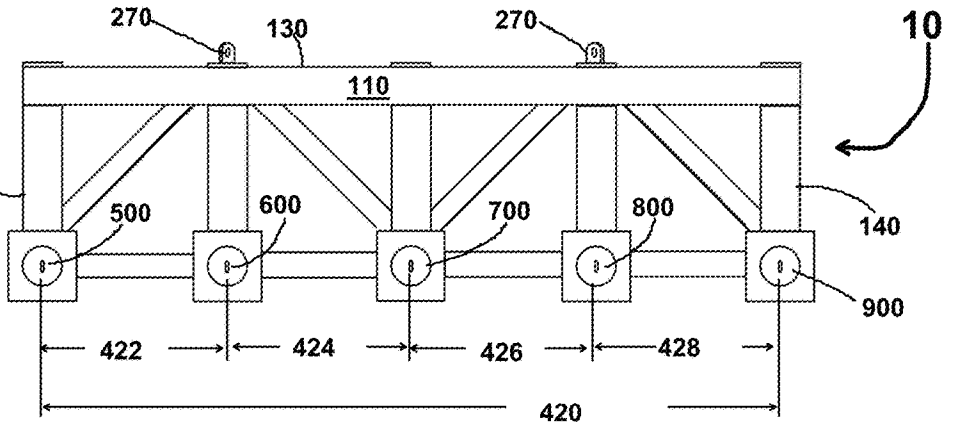
Figure 3B:
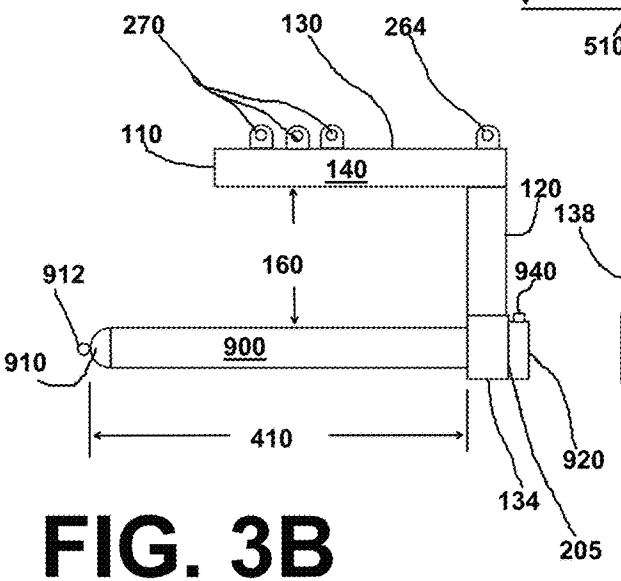
Figure 11A:
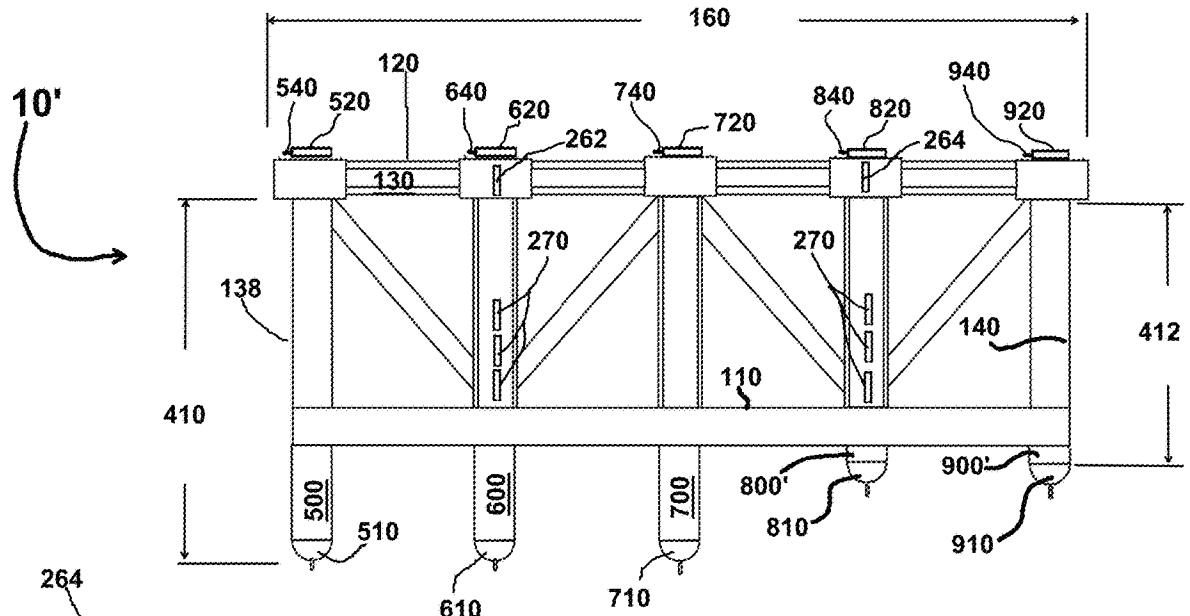
FIGS. 11A, 11B, and 11C respectively are top, right side, and front views of the lifting device of FIG. 1 with some shorter lifting arms/prongs.
Figure 11B:
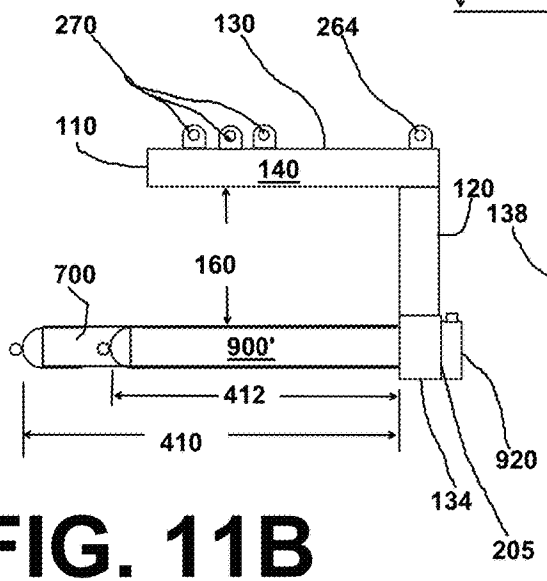
Figure 11C:
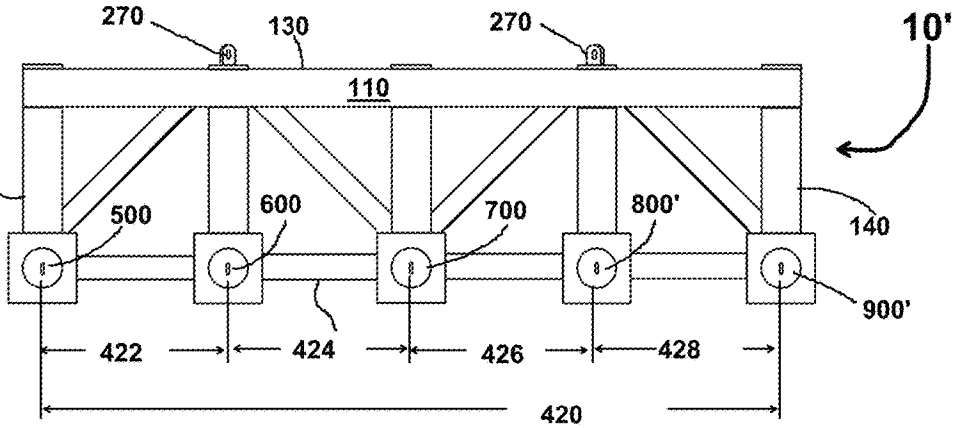

FIGS. 3A, 3B, and 3C, respectively, are top, right side, and front views of the lifting device 10 with lifting arms 500, 600, 700, 800, and 900 being of substantially equal length 410. FIGS. 11A, 11B, and 11C, respectively, are top, right side, and front views of the lifting device 10 with some shorter lifting prongs 800', 900'.

Frame 100 can comprise a set of structural members forming first/front end 110, second/rear end 120, top section/portion 130, bottom section/portion 134, and left 138 and right 140 sides. A first family of connectors, such as eyelets 262 and 264 can be provided on the top section 130 and at the second/rear end 120 of frame 100. A second family of connectors, such as eyelets 270, can be provided on the top section 130 and toward the first/front end 110 of frame 100. The second family of eyelets 270 can provide multiple choices for connecting points. For example, in FIGS. 1 and 2, three pairs of spaced apart eyelets 270 can be provided, thereby giving a user a choice of which of the three pairs of eyelets will be used to connect frame 100 to crane 1500.

In various embodiments there can be a vertical spacing 160 between the plurality of lifting arms (e.g., arms 500, 600, 700, 800, and/or 900) and the top section/portion 130 of frame 100. In various embodiments one or more of the plurality of lifting arms (e.g., arms 500, 600, 700, 800, and/or 900) can have a length 410 extending outside frame 100, as shown in FIGS. 2, 3A, and 3B. It will be understood that the length 410 of a lifting arm, as measured from where it extends outside of front/free end of the arm, is shorter than its length, as measured from its rear/attached end to its front/free end, the difference being the distance which is the lifting arm is recessed into frame 100 for attachment thereto. Referring e.g., to FIGS. 2 and 3A, the length 410 of lifting arm 500 measured from frame 100 is shorter than the length 550 of lifting arm 500 as measured from its rear end 520 to its front end 510. Henceforth, unless indicated otherwise, the "length" of a lifting arm refers to the distance it extends outside of the frame to its front end, as e.g., length 410 of arm 500 and length 412 of arm 900 as shown in FIG. 11C.

In various embodiments one or more of the lifting arms (e.g., arms 500, 600, 700, 800, and/or 900) can be detachably connectable to frame 100.

As shown in FIG. 1, in various embodiments a plurality of lifting arms 500, 600, 700, 800, and 900 can be provided with first/free ends (respectively 510, 610, 710, 810, and 910), wherein the first ends are rounded and/or frustoconically shaped. The rounding and/or frustoconical shape can assist the first ends in penetrating cavities of cargo units.

In various embodiments a plurality of lifting arms 500, 600, 700, 800, and 900 can be provided with first/front and second/rear ends (respectively 510,520; 610,620; 710,720; 810,820; and 910,920), wherein each of the plurality of lifting arms 500, 600, 700, 800, and 900 can be detachably connectable to the lifter 10 at their second/rear ends (respectively 520,620,720,820,920). In various embodiments each of the plurality of lifting arms 500, 600, 700, 800, and 900 can be substantially of the same length 410.

In various embodiments a plurality of lifting arms 500, 600, 700, 800, and 900 can be provided with first/front and second/rear ends (respectively 510,520; 610,620; 710,720; 810,820; and 910,920), wherein each of the plurality of lifting arms 500, 600, 700, 800, and 900 can be detachably connectable to the lifter at their second/rear ends (respectively 520,620,720,820,920), wherein various of the plurality of lifting arms 500, 600, 700, 800, and 900 can be of different lengths (e.g., in FIGS. 11A through 11C showing length 410 for lifting arms 500,600,700; and length 412 for lifting arms 800' and 900'). In various embodiments the ratio of lengths between the shortest of the plurality of lifting arms 500, 600, 700, 800, and 900 to the longest of the plurality of lifting arms 500, 600, 700, 800, and 900 can be about 0.25, 0.3, 0.4, 0.5, 0.6, 0.7, 0.75, 0.8, 0.9, 1.0. In various embodiments the ratio of lengths between the shortest of the plurality of lifting arms 500, 600, 700, 800, and 900 to the longest of the plurality of lifting arms 500, 600, 700, 800, and 900 can fall within a range of between any two of the above specified ratios.

In various embodiments the detachable connection between the at least one lifting arm 500, 600, 700, 800, and 900 and the frame 100 of the lifter 10 can comprise a pin connector. Pin connectors are shown in FIGS. 1 through 3. For example lifting arm 500 can be detachably connectable to frame 100 of lifter 10 via first frame opening 201 and at least one removable connecting pin 540 passing through opening 211 and lifting arm opening 530. Similar types of detachable connections can be made for lifting arms 600, 700, 800, and 900—e.g., second frame opening 202 and removable connecting pin 640 passing through connector opening 212 and lifting arm opening 630 for lifting arm 600; third frame opening 203 and removable connecting pin 740 passing through connector opening 213 and lifting arm opening 730 for lifting arm 700; fourth frame opening 204 and removable connecting pin 840 passing through connector opening 214 and lifting arm opening 830 for lifting arm 800; and fifth frame opening 205 and removable connecting pin 940 passing through connector opening 215 and lifting arm opening 930 for lifting arm 900.

In various embodiments the detachable connection can comprise a set screw connector. In various embodiments multiple pins and openings can be provided for each lifting arm (e.g., pins 540, 540' inserted respectively into connector openings 211,211' and lifting arm openings 530,530' for arm 500; pins 640, 640' inserted respectively into connector openings 212,212' and lifting arm openings 630,630' for arm 600; pins 740, 740' inserted respectively into connector openings 213,213' and lifting arm openings 730,730' for arm 700; pins 840, 840' inserted respectively into connector openings 214,214' and lifting arm openings 830,830' for arm 800; and pins 940, 940' inserted respectively into connector openings 215,215' and lifting arm openings 930,930' for arm 900). In various embodiments one or more frame receiving openings (e.g., 201,202,203,204, and/or 205) can include a rear stop to prevent the second/rear ends (520,620,720,820, 920) of lifting arms 500,600,700,800,900 from sliding too far past second/rear end 120 of frame 100 and/or for respectively aligning lifting arm openings 530,630,730,830, and 930 with connector openings 211,212,213,214, and 215.

In various embodiments the quantity of the at least one lifting arm (e.g., lifting arms 500, 600, 700, 800, and/or 900) being detachably connected to the frame 100 of the lifting device 10 (such as through one or more openings 201, 202, 203, 204, and/or 205 in frame 100) is selectable by a user. In various embodiments the quantity of at least one lifting arm (e.g., lifting arms 500, 600, 700, 800, and/or 900) being detachably connected to the lifting device 10 selectable by a user is at least 1, 2, 3, 4, 5, 6, 7, 8, 9, 10, 11, 12, 13, 14, or 15. In various embodiments the quantity of the at least one lifting arm (e.g., lifting arms 500, 600, 700, 800, and/or 900) detachably connected to the lifting device 10 selectable by a user can fall within a range of between any two of the above specified quantities.

Figure 4:
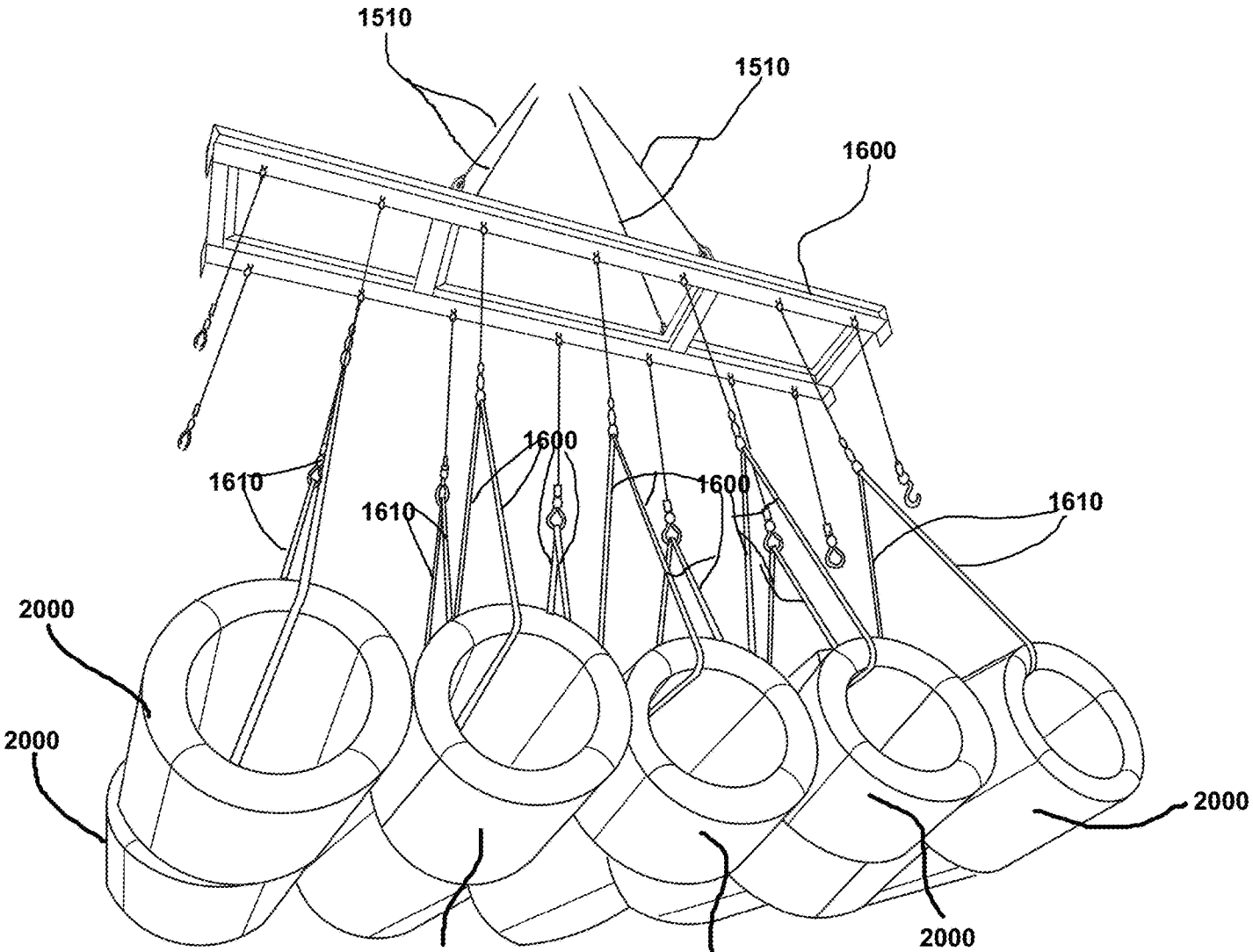
FIG. 4 is a lower perspective of the prior art method of lifting coils of wire using slings.
Figure 6:
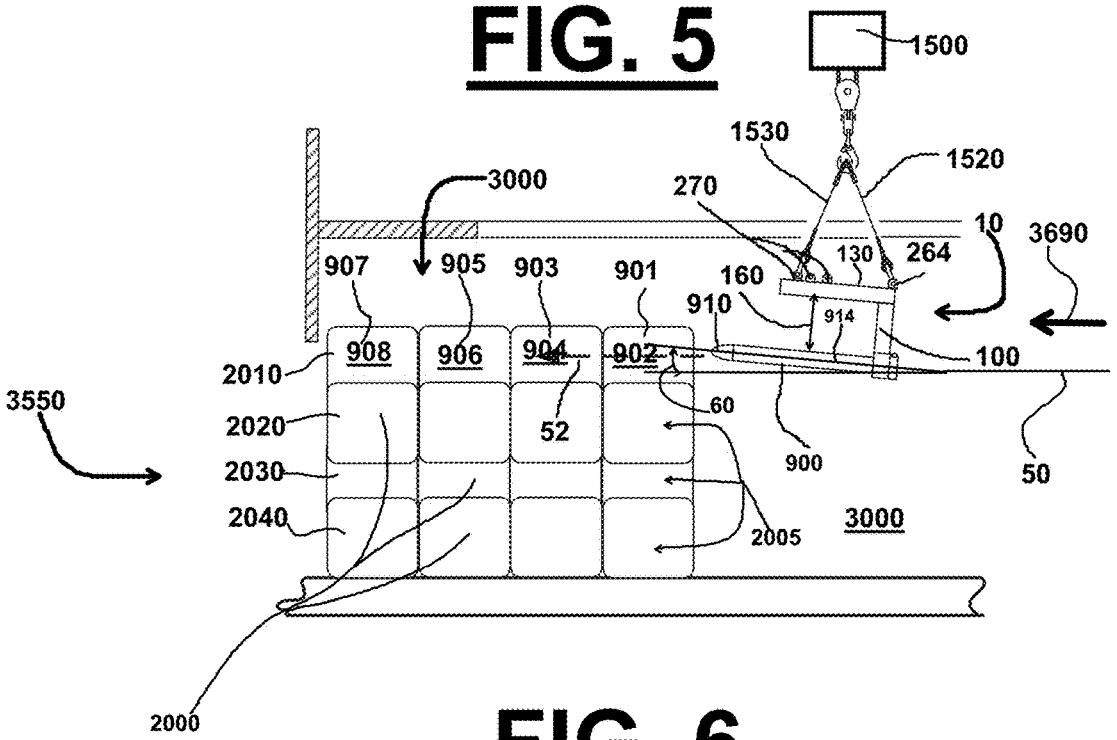
FIG. 6 is a right side view of the lifting device of FIG. 5 schematically showing the lifting device being moved towards a set of stored coils in a vessel's hold, and indicating that the arms/prongs of the lifting device are angled upwardly from a generally horizontal position while the lifter is suspended from a crane.

FIG. 4 is a lower perspective of the prior art method of lifting coils of wire 2000 using slings 1610 suspended from a spreader bar 1600, which in turn is suspended from a plurality of lifting cables 1510. In this prior art method a plurality of slings 1610 are manually threaded through the cavities 2005 of the wire coils 2000 before lifting. Manually threading slings 1610 is time consuming and dangerous as each of the coils of wire must be manually threaded and a handler must manipulate the coils during this threading process so that the slings can be threaded. For example, FIG. 6 shows a typical stowage configuration for a plurality of units of cargo 3550, in this case coils of wire 2000, in the hold 3000 of a vessel 2900. Typically, as shown in FIG. 6, units of cargo are closely spaced next to each other (e.g., coiled wire units 901,903, 905, and 907). For a sling 1610 using the prior art method to be threaded through the cavities of two of these adjacent coiled wire units (e.g., units 901 and 903) then the units 901,903 would have to be manually manipulated to provide a gap between coil wire unit 903 and 905, allowing the sling 1610 to pass through this gap. This manual manipulation is time consuming and dangerous, as one of the coiled wire units could shift and/or fall on the manipulating person.

In various embodiments the method and apparatus can be used to transfer a plurality of cargo units 3550 from the hold 3000 of a vessel 2900 to another vessel such as a barge 3500, and/or to a dock 3300 as shown, e.g., in FIGS. 9 and 10, respectively. In various embodiments the method and apparatus moves a plurality of cargo units when spaced above a water surface (see e.g., in FIG. 10 water surface 3110 when transferring to dock 3300, and in FIG. 9 water surface 3160 when transferring to bare 3500).

Figure 5:
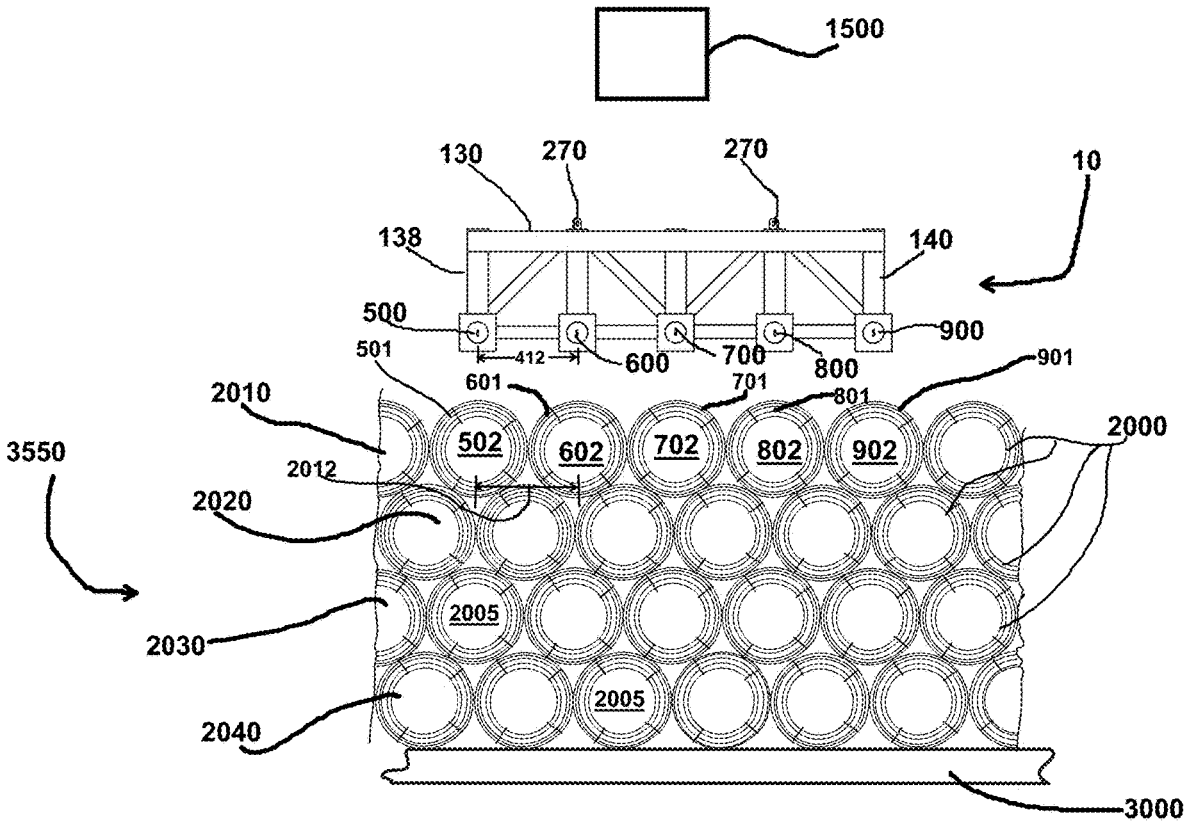
FIG. 5 is a front view of the lifting device of FIG. 1 schematically showing the lifter/lifting device above a set of stored coils in a vessel's hold (schematically indicating movement of the lifter/lifting device towards the set of stored coils).

FIG. 5 is a front view of the lifting device 10 schematically showing the lifting device 10 above a set of wire coils 3550 stored in rows (e.g., figure row 2010, second row 2020, third row 2030, and fourth row 2040) in a vessel's hold 3000.

FIG. 6 is a right side view of the lifting device 10 schematically showing the lifting device 10 being moved towards (arrow 3690) and penetrating (arrow 52) a set of stored coils 3550 in a vessel's hold 3000, and indicating that the lifting arms 500,600,700,800,900 of the lifting device 10 are angled upwardly (angle of inclination 60) from, and relative to, a generally horizontal plane 50.

Figure 7:
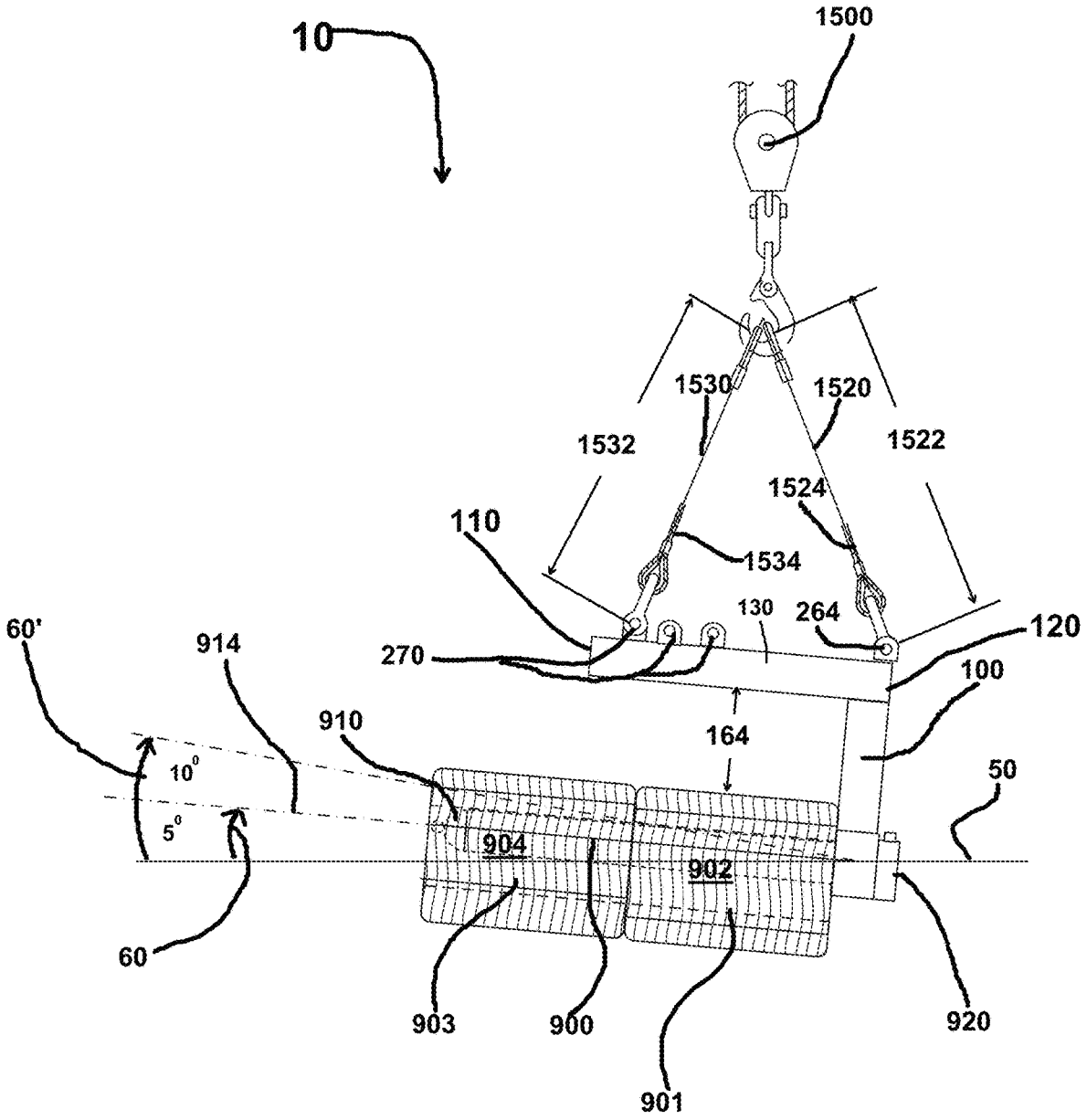
FIG. 7 is a right side view of the lifting device of FIG. 6 schematically showing the lifting device now having lifted a plurality of coiled wires and also showing the angled upwardly condition of the lifting device when lifting and moving the plurality of coiled wires.
Figure 8:
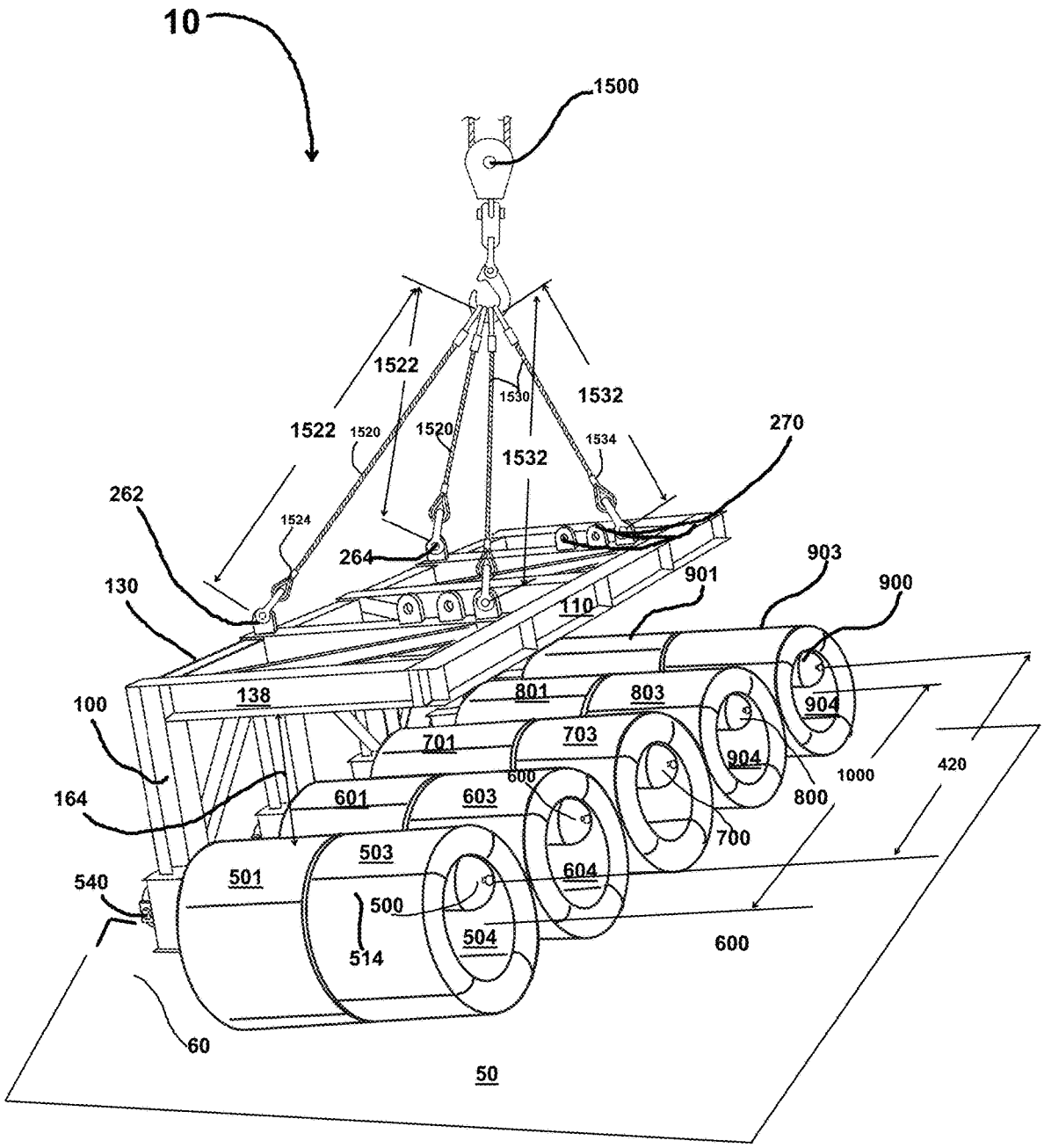
FIG. 8 is a left side perspective view of the lifting device of FIG. 7.

FIGS. 7 and 8 schematically show the lifting device 10 now having lifted a plurality of coiled wires 501,503; 601,603; 701,703; 801,803; and 901,903 and also showing the angled upwardly condition (angle 60) of the lifting device 10 when lifting and moving the plurality of coiled wires 501,503; 601,603; 701,703; 801,803; and 901,903. The angle 60 can be controlled by the relative lengths 1522 and 1532 of supporting lines/lifting cables 1520,1530. In various embodiments turnbuckles 1524, 1534 can be used to adjust the relative lengths 1522 and 1532 of supporting lines 1520,1530.

FIG. 8 is a left side perspective view of the lifting device 10 appearing in FIG. 7 schematically showing the lifting device 10 having lifted the same plurality of coiled wires 501,503; 601,603; 701,703; 801,803; and 901,903, and also showing the angled upwardly condition (angle 60) of the lifting device 10 when lifting and moving the plurality of coiled wires 501,503; 601,603; 701,703; 801,803; and 901, 903.

As can be seen in FIGS. 6-8, the vertical spacing 160 between top section/portion 130 of frame 100 and the plurality of lifting arms 500, 600, 700, 800, 900, can be large enough so that a gap 164 exists after first ends 510, 610, 710, 810, 910 of plurality of lifting arms 500, 600, 700, 800, 900, have penetrated the respective cavities of plurality of units of cargo units/coiled wires 501,503; 601,603; 701,703; 801,803; and 901,903. Otherwise, complete penetration by the entire lengths of lifting arms 500, 600, 700, 800, 900 into cavities 502, 602, 702, 802, 902 could be blocked by a lack of adequate vertical spacing 160.

In various embodiments there can be horizontal spacing between the respective center lines of adjacent lifting arms, e.g., horizontal spacings 422,424,426, and 428, as shown in FIG. 1. In various embodiments, the width presented by the totality of lifting arms, measured from the centerline of the first lifting arm to the centerline of the last lifting arm, is generally consistent with the width presented by the totality of cargo units to be picked up at one time by lifter 10, measured from the center of the cavity of the first cargo unit to the center of the cavity of the last cargo unit (for example, width 420 presented by the totality of the lifting arms 500,600,700,800, and 900 is generally consistent with width 1000 presented by adjacent cargo units 503,603,703,803, 903, as shown in FIG. 8).

In various embodiments, the horizontal spacing between adjacent lifting arms, measured from their respective center lines, can be generally consistent with the horizontal spacing between adjacent cargo units to be picked up, measured from the respective centers of the respective cavities of the adjacent cargo units (for example, as shown in FIG. 5, horizontal spacing 422 between adjacent lifting arms 500 and 600 is generally consistent with horizontal spacing 2012 between adjacent cargo units 501 and 601 in row 2010).

Figure 9A:
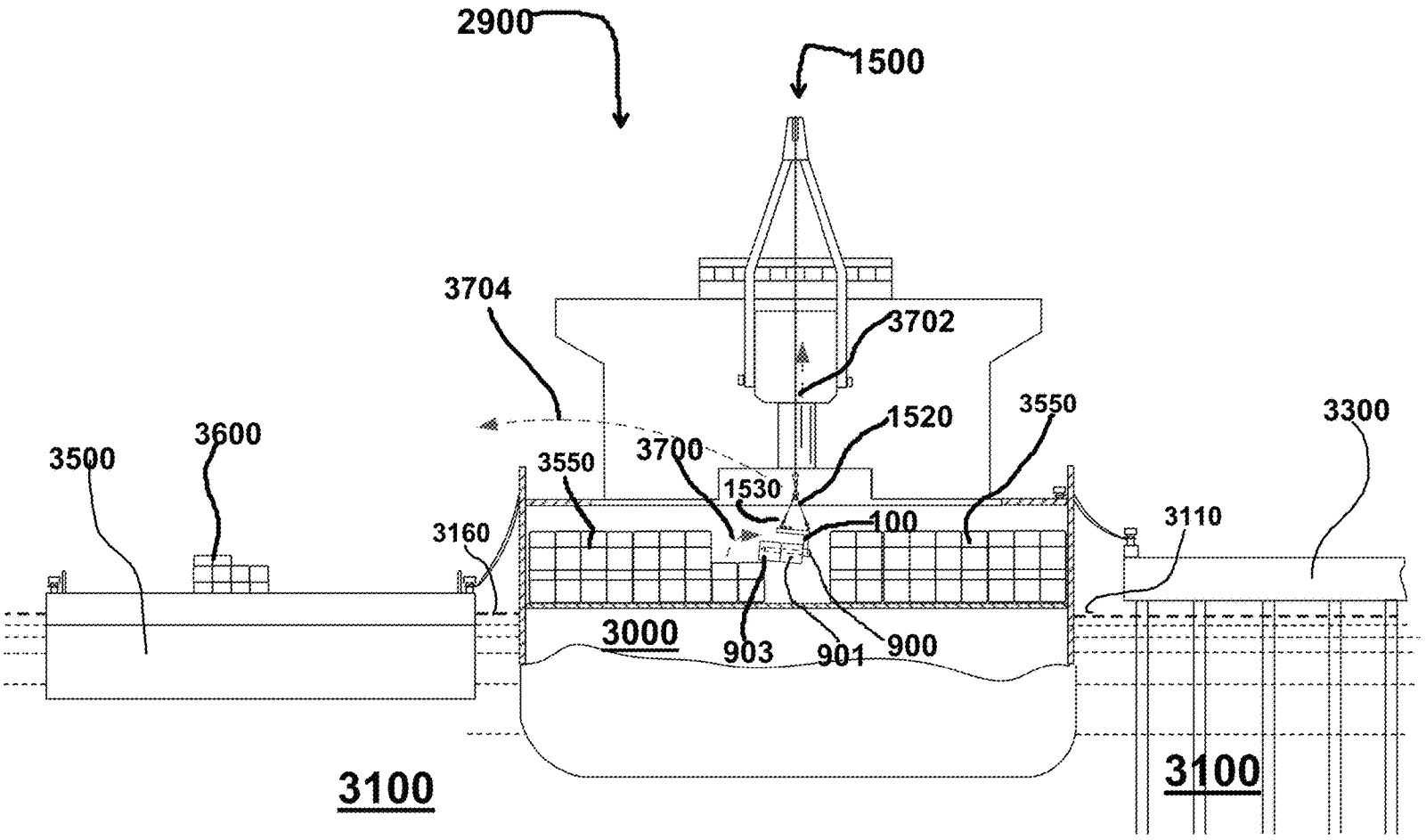
FIG. 9A is a right side view of the lifting device of FIG. 6 schematically showing the lifting device shortly after having lifted the plurality of coiled wires in FIGS. 7 and 8, and also showing the angled upwardly condition of the lifting device when lifting and moving the plurality of coiled wires, and schematically indicating that the plurality of coiled wires will be transferred, moved to, deposited, and stored on an adjacent barge (with some coils already having been deposited on the adjacent barge).

FIG. 9A is aright side view of the lifting device 10 schematically showing via arrow 3700 the lifting device 10 shortly after having lifted the plurality of coiled wires 501,503; 601,603; 701,703; 801,803; and 901,903, and also showing the angled upwardly condition (angle of inclination 60) of the arms of lifting device 10 when lifting and moving the plurality of coiled wires 501,503; 601,603; 701,703; 801,803; and 901,903, and schematically indicating via arrows 3702 and 3704 that the plurality of coiled wires 501,503; 601,603; 701,703; 801,803; and 901,903 will be moved and deposited on an adjacent barge 3500 (with some coils 3600 already having been deposited on the adjacent barge 3500).

Figure 9B:
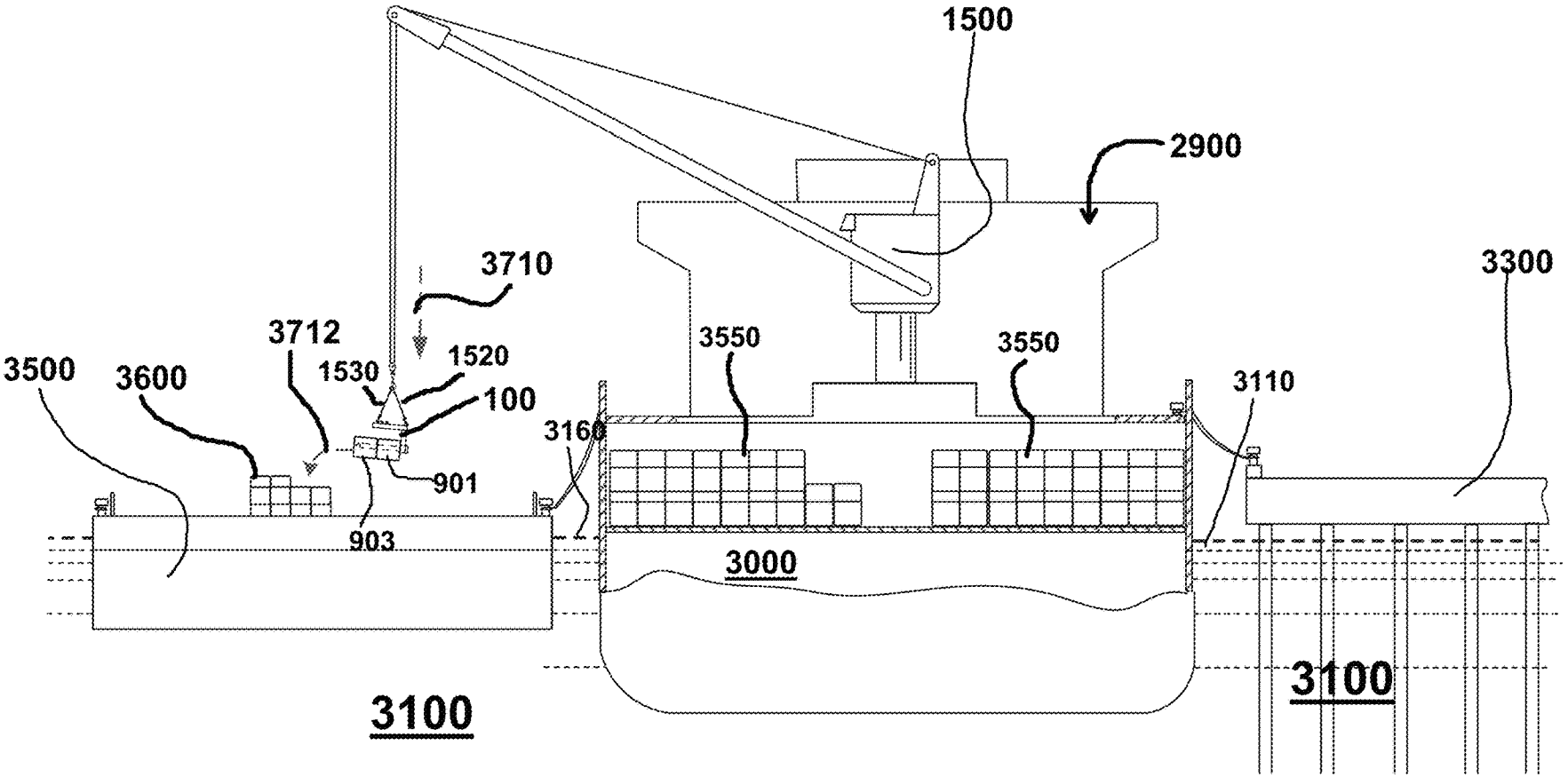
FIG. 9B shows the crane moving the plurality of coils for deposit on the barge.

FIG. 9B schematically shows via arrows 3710 and 3712 the crane 1500 moving the plurality of coiled wires 501,503; 601,603; 701,703; 801,803; and 901,903 for deposit on the barge 3500.

Figure 10A:
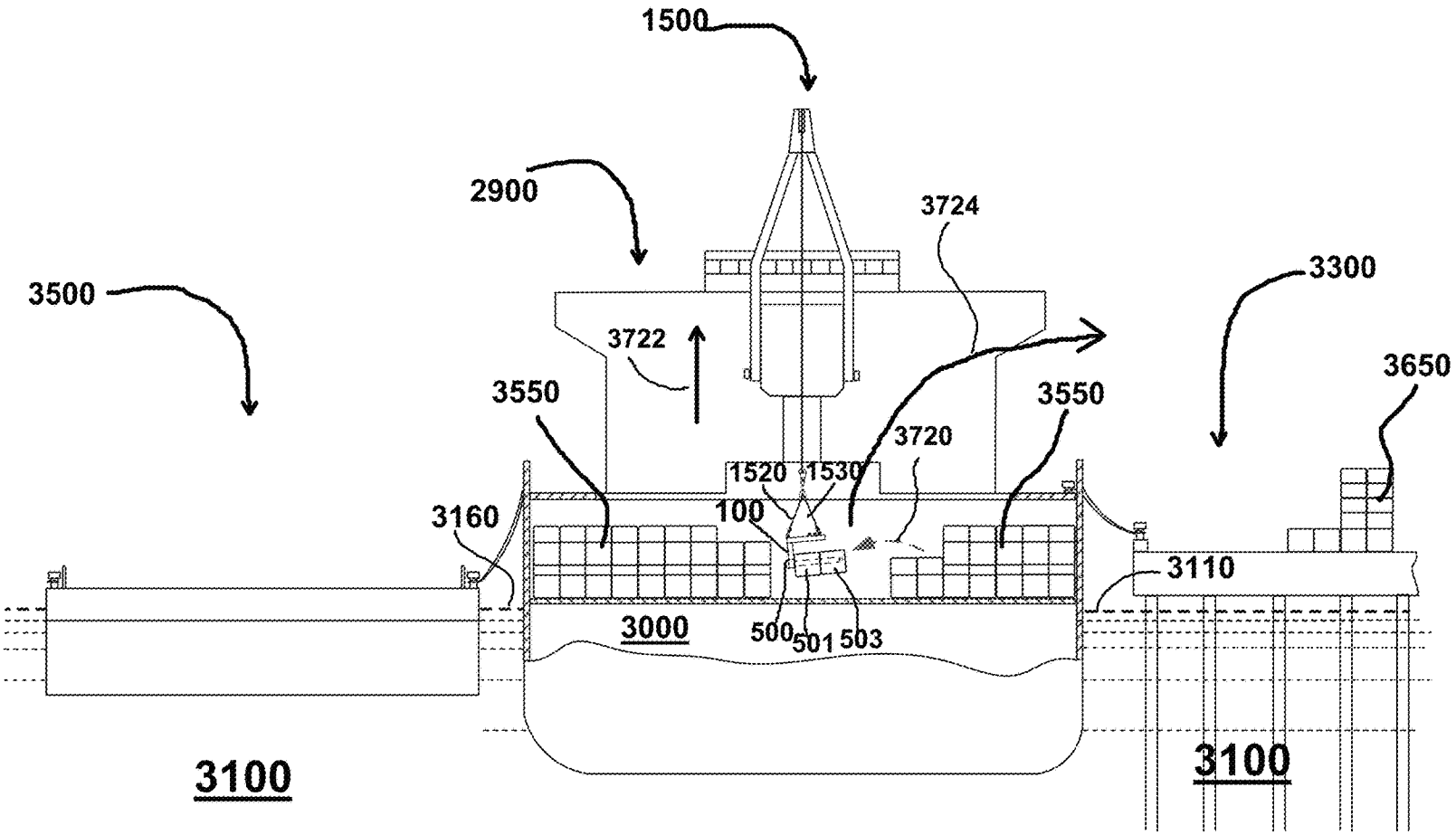
FIG. 10A is a left side view of the lifting device of FIG. 6 schematically showing the lifting device shortly after having lifted the plurality of coiled wires in FIGS. 7 and 8, and also showing the angled upwardly condition of the lifting device when lifting and moving the plurality of coiled wires, and schematically indicating that the plurality of coiled wires will be moved and stored on an adjacent dock (with some coils already having been stored on the adjacent dock).

FIG. 10A is a left side view of the lifting device 10 schematically showing via arrow 3720 the lifting device 10 shortly after having lifted the plurality of coiled wires 501,503; 601,603; 701,703; 801,803; and 901,903, and also showing the angled upwardly condition (angle of inclination 60) of the arms of lifting device 10 when lifting (shown via arrow 3722) and moving the plurality of coiled wires 501,503; 601,603; 701,703; 801,803; and 901,903, and schematically indicating via arrow 3724 that the plurality of coiled wires 501,503; 601,603; 701,703; 801,803; and 901, 903 will be moved and deposited on an adjacent dock 3300 (with some coils 3650 already having been stored on the adjacent dock 3300).

Figure 10B:
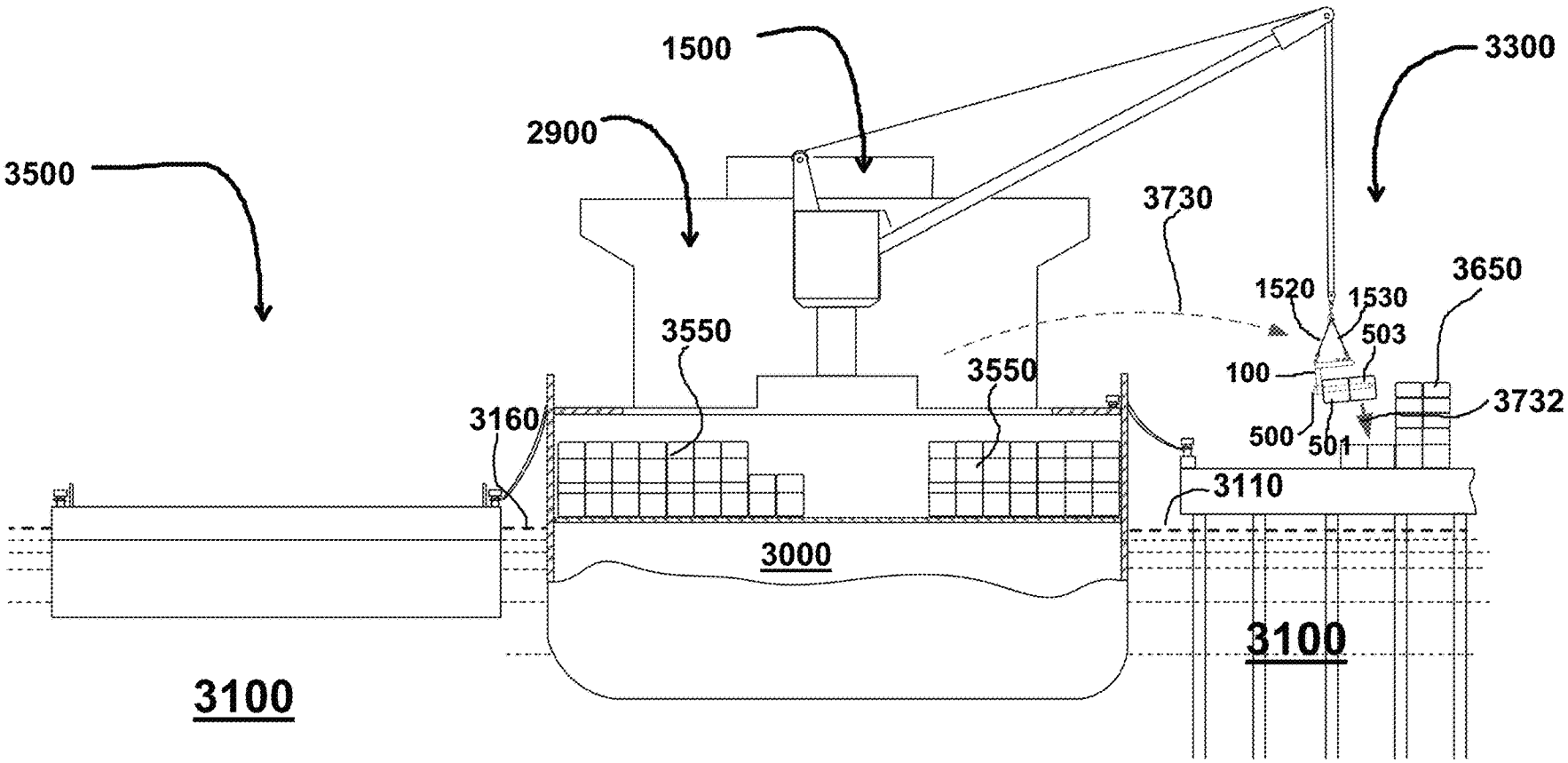
FIG. 10B shows the crane moving the plurality of coils for deposit on the dock.

FIG. 10B schematically shows via arrows 3730 and 3732 the crane 1500 moving the plurality of coiled wires 501,503; 601,603; 701,703; 801,803; and 901,903 for deposit on the dock 3300.

Various Embodiments of Method

In various embodiments is provided a method of moving a plurality of cargo units 3550 (e.g., 901, 801, 701, 601, and 501), each of the cargo units (e.g., 901, 801, 701, 601, and 501) having a cavity (e.g., respectively 902, 802, 702, 602, and 502), comprising the steps of:

(a) providing a lifter/lifting device 10, the lifter 10 including:

(i) a frame 100 with first/front 110 and second/rear 120 ends and top 130 and bottom 134 portions; and (ii) at least one lifting arm (e.g., 900, 800, 700, 600, and 500) having spaced apart first/front/free (e.g., respectively 910, 810, 710, 610, and 510) and second/rear (e.g., respectively 920, 820, 720, 620, and 520) ends, wherein the second/rear end (e.g., respectively 920, 820, 720, 620, and 520) is detachably connected to the frame 100 at the second/rear end 120 of the frame 100;

(b) moving the lifter 10 to a position immediately adjacent the plurality of units of cargo 3550 (e.g., see FIGS. 5 through 9B);

(c) causing each first/front/free end (e.g., respectively 910, 810, 710, 610, and 510) of the at least one lifting arm (e.g., respectively 900, 800, 700, 600, and 500) to penetrate at least one cavity (e.g., respectively 902, 802, 702, 602, and 502) of the at least one cargo unit (e.g., respectively 901, 801, 701, 601, and 501) of the plurality of units of cargo 3550;

(d) while each first/front/free end (e.g., respectively 910, 810, 710, 610, and 510) of the at least one lifting arm (e.g., 900, 800, 700, 600, and 500) has penetrated the at least one cavity (e.g., respectively 902, 802, 702, 602, and 502) of the at least one cargo unit (e.g., respectively 901, 801, 701, 601, and 501) of the plurality of units of cargo 3550, a crane 1500 raising the at least one cargo unit (e.g., respectively 901, 801, 701, 601, and 501) of the plurality of units of cargo 3550 to an elevated position (see e.g., FIGS. 6-8 and 9A and 9B);

(e) after step "d", while each first/front/free end (e.g., respectively 910, 810, 710, 610, and 510) of the at least one lifting arm (e.g., respectively 900, 800, 700, 600, and 500) has penetrated at least one cavity (e.g., respectively 902, 802, 702, 602, and 502) of the at least one cargo unit (e.g., respectively 901, 801, 701, 601, and 501) of the plurality of units of cargo 3550, the crane 1500 moving the lifter 10 and the at least one cargo unit (e.g., respectively 901, 801, 701, 601, and 501) of the plurality of units of cargo 3550 to a second position (see e.g., FIGS. 6-8 and 9A and 9B) which second position is spaced apart from its position in step "b" (see e.g., FIGS. 9A and 9B), wherein during this step "e" each first/front/free end (e.g., respectively 910, 810, 710, 610, and 510) of the at least one lifting arm (e.g., 900, 800, 700, 600, and 500) is elevated compared to each second/rear end (e.g., respectively 920, 820, 720, 620, and 520) of the at least one lifting arm (see e.g., FIGS. 6-8 and 9A and 9B);

(f) after step "e, the crane 1500 depositing the at least one cargo unit (e.g., respectively 901, 801, 701, 601, and 501) of the plurality of units of cargo 3550 at the second position by lowering the lifter/lifting device 10; and (g) after the lowering of the lifter/lifting device 10, each first/front/free end (e.g., respectively 910, 810, 710, 610, and 510) of the at least one lifting arm (e.g., 900, 800, 700, 600, and 500) is withdrawn from the at least one cavity (e.g., respectively 902, 802, 702, 602, and 502) of the at least one cargo unit (e.g., respectively 901, 801, 701, 601, and 501) of the plurality of cargo units 3550.

In various embodiments during step "e" each first/front/free end (e.g., 910, 810, 710, 610, and 510) of the at least one lifting arm (respectively, 900, 800, 700, 600, and 500) is elevated compared to each second/rear end (respectively, 920, 820, 720, 620, and 520) of the at least one lifting arm (respectively, 900, 800, 700, 600, and 500), the longitudinal axis (respectively, 914, 814, 714, 614, and 514) of the at least one lifting arm (respectively, 900, 800, 700, 600, and 500) forms an angle of inclination 60 relative to a generally horizontal plane 50 which is greater than 5 degrees. In various embodiments the angle of inclination 60 can be greater than 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, or 89 degrees. In various embodiments the angle of inclination 60 can fall within a range of between any two of the above specified degree measurements for a minimum angle of inclination.

In various embodiments between steps "c" and "e" the crane 1500 can cause the longitudinal axis (respectively, 914, 814, 714, 614, and 514) of the at least one lifting arm (respectively, 900, 800, 700, 600, and 500) to increase its angle of inclination 60 relative to a generally horizontal plane 50 (see e.g., angle 60 in FIG. 7). In various embodiments the increase in the angle of inclination 60 between steps "c" and "e" can be greater than 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, or 89 degrees. In various embodiments the increase in the angle of inclination 60 between steps "c" and "e" can fall within a range of between any two of the above specified degree measurements for an increase in the angle of inclination 60.

In various embodiments, prior to step "c" and/or after step "f", the length 1532 of lifting cables 1530 can be shortened relative to the length 1522 of lifting cables 1520, or the length 1522 of lifting cables 1520 can be lengthened relative to the length 1532 of lifting cables 1530, in order to cause the longitudinal axis (respectively, 914, 814, 714, 614, and 514) of the at least one lifting arm (respectively, 900, 800, 700, 600, and 500) to increase its angle of inclination 60 relative to a generally horizontal plane 50 (see e.g., angle 60 in FIG. 7). Similarly, in various embodiments, prior to step "c" and/or after step "f", the length 1532 of lifting cables 1530 can be lengthened relative to the length 1522 of lifting cables 1520, or lifting cables 1530, in order to decrease the angle of inclination 60 relative to a generally horizontal plane 50. In various embodiments such increase or decrease in the angle of inclination 60 can be greater than 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 75, 80, 85, or 89 degrees. In various embodiments the increase or decrease in the angle of inclination 60 can fall within a range of between any two of the above specified degree measurements for an increase in the angle of inclination 60.

In various embodiments, during step "d", the at least one cargo unit (e.g., 901, 801, 701, 601, and 501, respectively) each includes first and second ends, and has each respective first end placed in an elevated condition relative to each respective second end (see e.g., FIG. 7). In various embodiments the at least one cargo unit (e.g., respectively 901, 801, 701, 601, and 501) each include a longitudinal centerline, and during step "d" each such longitudinal centerline has an angle of inclination substantially equal to the angle of inclination of the at least one lifting arm (e.g., respectively 900, 800, 700, 600, and 500) penetrating and supporting the at least one cargo unit (respectively, 901, 801, 701, 601, and 501).

In various embodiments a plurality of lifting arms (e.g., 900, 800, 700, 600, and 500) can be provided with first/front and second/rear ends (respectively, 910,920; 810,820; 710, 720; 610,620, and 510,520), wherein each of the plurality of lifting arms (900, 800, 700, 600, and 500) can be detachably connectable to the frame 100 of the lifter 10 at their second ends (respectively, 920, 820, 720, 620, and 520), wherein various of the plurality of lifting arms can be of different lengths (see e.g., lengths 410 and 412 shown in FIGS. 11A, 11B, and 11C). In various embodiments the ratio of lengths (length 412/length 410) between the shortest of the plurality of lifting arms (e.g., 800,900) to the longest of the plurality of lifting arms (e.g., 500,600,700) can be about 0.25, 0.3, 0.4, 0.5, 0.6, 0.7, 0.75, 0.8, 0.9, 1.0. In various embodiments the ratio of lengths (length 412/length 410) between the shortest of the plurality of lifting arms (e.g., 800,900) to the longest of the plurality of lifting arms (e.g., 500,600,700) can fall within a range of between any two of the above specified ratios.

In various embodiments the detachable connection of the at least one lifting arm (e.g., 900, 800, 700, 600, and 500) to the frame 100 of the lifter 10 can comprise a pin connector (e.g., pin 540 for lifting arm 500, pin 640 for lifting arm 600, pin 740 for lifting arm 700, pin 840 for lifting arm 800, and pin 940 for lifting arm 900). In various embodiments the detachable connection can comprise a set screw connector.

In various embodiments the quantity of the at least one lifting arm (e.g., lifting arms 500, 600, 700, 800, and/or 900) detachably connected to the frame 100 of lifting device 10 is selectable by a user. In various embodiments the quantity of the at least one lifting arm (e.g., lifting arms 500, 600, 700, 800, and/or 900) detachably connected to the frame 100 of the lifting device 10 selectable by a user is at least 1, 2, 3, 4, 5, 6, 7, 8, 9, 10, 11, 12, 13, 14, or 15. In various embodiments the quantity of the at least one lifting arm (e.g., lifting arms 500, 600, 700, 800, and/or 900) detachably connected to the frame 100 of the lifting device 10 selectable by a user can fall within a range of between any two of the above specified quantities.

In various embodiments, one or more of the lifting arms can be provided with a connector at the lifting arm first/front end, such as connector eyelets 512,612,712,812, and 912, each connector extending, respectively, from the front ends 510, 610, 710, 810, and 910 of lifting arms 500, 600, 700, 800, and 900, as shown in FIG. 2. Such connector provided at the first/front/free end of a lifting arm can facilitate the installation and/or removal of such lifting arm from the frame 100 of lifter 10. For example, as shown in FIG. 2, eyelet 512 can provide a convenient point for attaching a cable (not shown) which can be used to pull lifting arm 500 out of frame 100) when connecting pin 540 is disengaged from connector opening 211).

Figure 12:
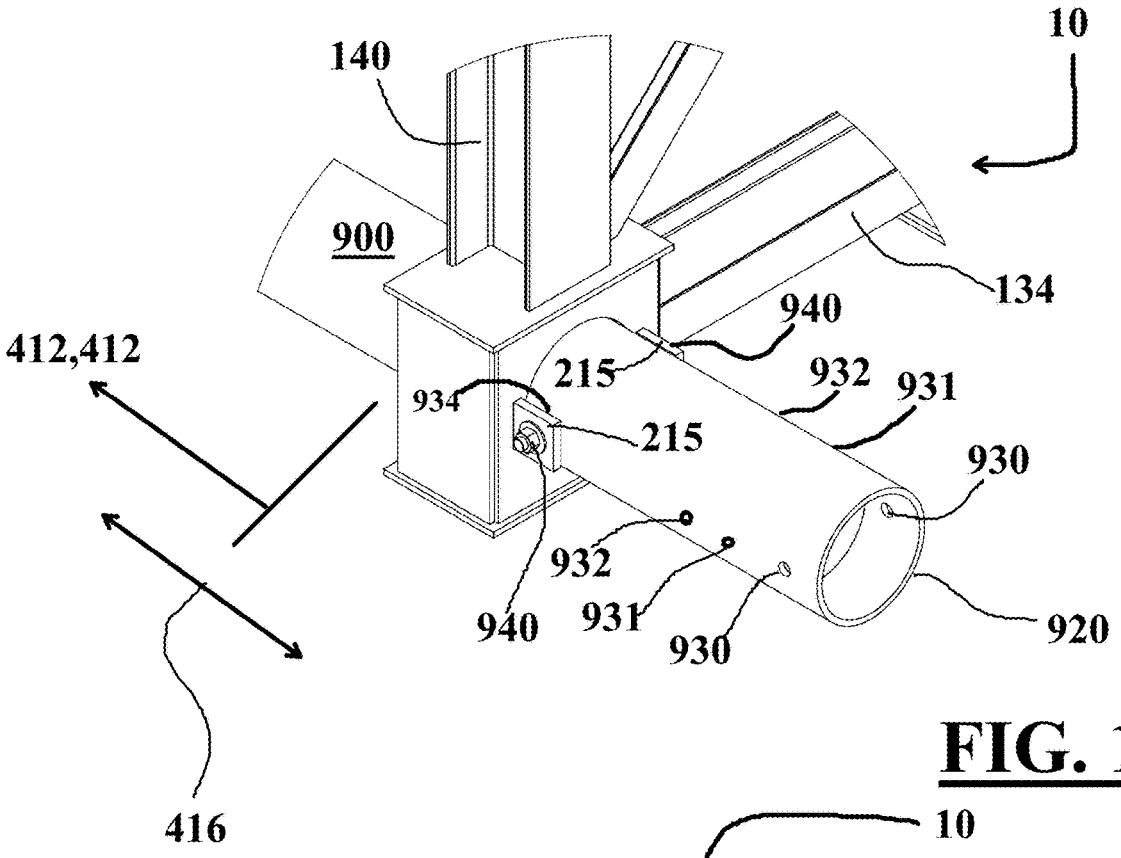
FIG. 12 is an enlarged perspective view of showing an alternative embodiment of a lifting arm/prong detachably connected to the frame which can be used to selectably adjust the pickup length of the lifting arm/prong with respect to the frame.
Figure 13:
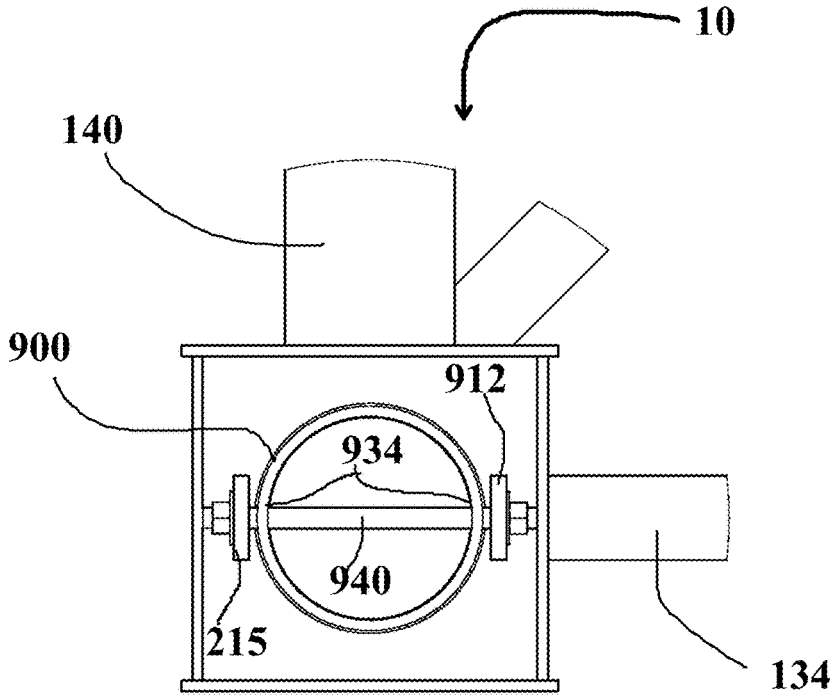
FIG. 13 is a rear view of the lifting arm/prong shown in FIG. 12.

FIG. 12 is an enlarged perspective view of showing an alternative embodiment of a lifting arm/prong 900 detachably connected to the frame 100 via connecting pin/bolt 940 and connector brackets 215, which can be used to selectably adjust the pickup length of the lifting arm/prong 900 with respect to the frame 100 via a selection of one of the pairs of longitudinally spaced paired openings 930, 931, 932, or 934. FIG. 13 is a rear view of the lifting arm/prong 900 shown in FIG. 12.

Figure 14:
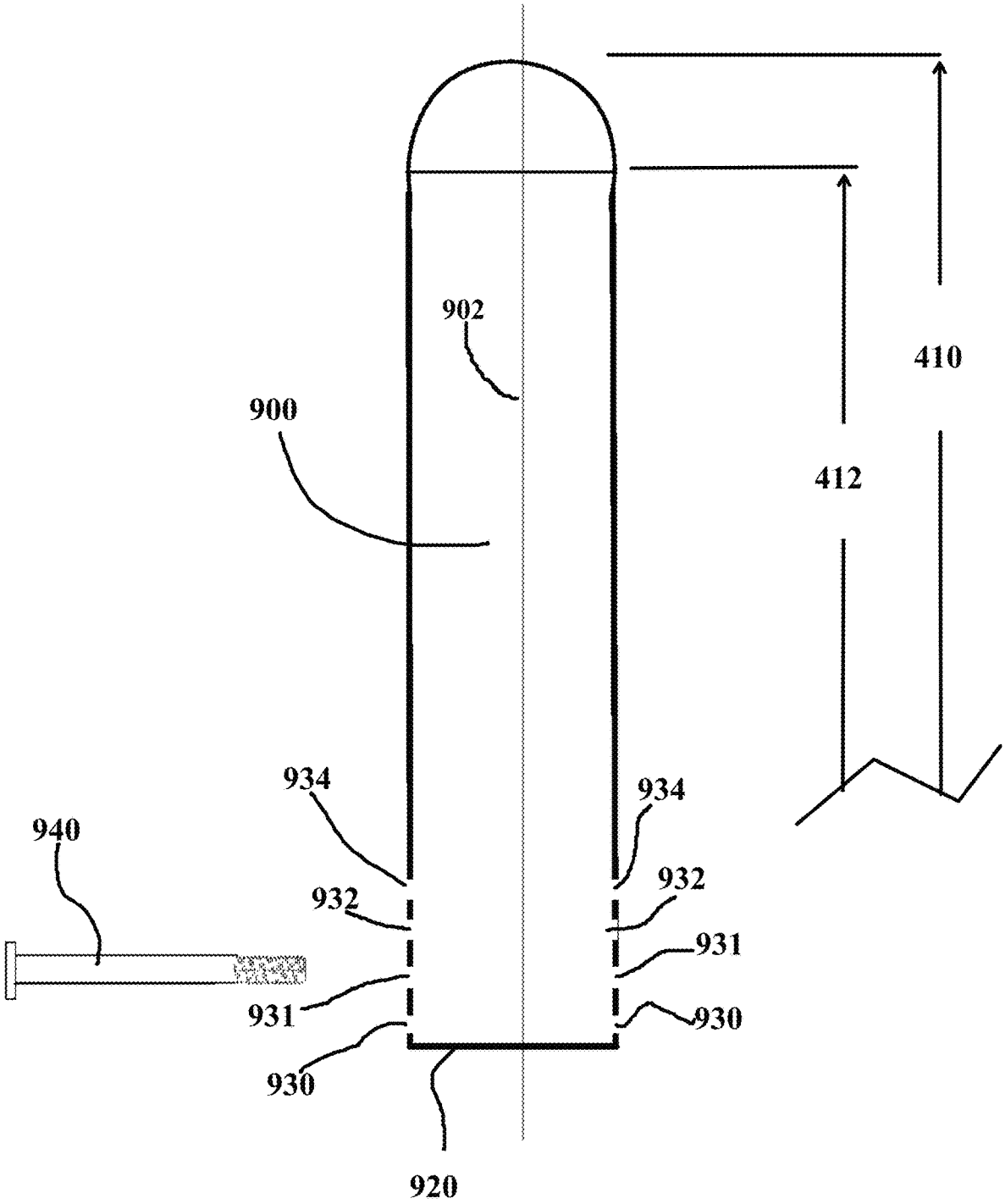
FIG. 14 is a top view of the lifting arm/prong shown in FIG. 12 showing the configuration of the longitudinally spaced apart paired connector openings with respect to the longitudinal centerline of the lifting arm/prong.

FIG. 14 is a top view of a lifting arm/prong 900 showing the configuration of the plurality of pairs of longitudinally spaced apart paired connector openings (e.g., 930, 931, 932, and/or 934) with respect to the longitudinal centerline 902 of the lifting arm/prong 900. The horizontal arrows schematically indicating which of the connector openings are paired to each other.

In various embodiments, one or more of the lifting arms/prongs (e.g., 900, 800, 700, 600, and/or 500) can each be provided with a plurality of user selectable longitudinally spaced apart paired positioning connector openings (which set of a plurality of longitudinally spaced apart paired connector openings can be located closer to the second end of each lifting arm/prong). For example lifting arm/prong 900 can be provided with selectable paired connector openings 930, 931, 932, and 934 which are longitudinally spaced about the longitudinal centerline 902 of lifting arm/prong 900. The longitudinally spaced apart paired connector openings allow a user to select a desired length for a particular arm/prong extending outside of frame 100. For example, the longest length 410 for arm/prong 900 can be achieved by using connecting pin/bolt 940 with paired openings 930 and connector brackets 215, and the shortest length 412 of arm/prong 900 by using paired openings 934 and connector brackets.

As other examples lifting arm/prong 500 can be provided with selectable paired connector openings 530, 531, 532, and 534 which are longitudinally spaced about the longitudinal centerline 502 of lifting arm/prong 500 (selectively usable with pin/bolt 540 and connector brackets 211 for adjusting the pickup length of the arm/prong); lifting arm/prong 600 can be provided with selectable paired connector openings 630, 631, 632, and 634 which are longitudinally spaced about the longitudinal centerline 602 of lifting arm/prong 600 (selectively usable with pin/bolt 640 and connector brackets 212 for adjusting the pickup length of the arm/prong); lifting arm/prong 700 can be provided with selectable paired connector openings 730, 731, 732, and 734 which are longitudinally spaced about the longitudinal centerline 702 of lifting arm/prong 700 (selectively usable with pin/bolt 740 and connector brackets 213 for adjusting the pickup length of the arm/prong); and lifting arm/prong 800 can be provided with selectable paired connector openings 830, 831, 832, and 834 which are longitudinally spaced about the longitudinal centerline 802 of lifting arm/prong 800 (selectively usable with pin/bolt 840 and connector brackets 214 for adjusting the pickup length of the arm/prong).

In various embodiments the at least two (2) pairs of longitudinally spaced apart paired connector openings are provided in a pickup arm/prong which allow a user to select a desired arm pickup length for the particular arm/prong extending outside of frame 100. In various embodiments the quantity of pairs of longitudinally spaced art paired connector openings in any one pickup arm/prong can be at least 2, 3, 4, 5, 6, 7, 8, 9, 10, 11, 12, 13, 14, or 15 pairs. In various embodiments the quantity of pairs of longitudinally spaced art paired connector openings in any one pickup arm/prong can fall within a range of between any two of the above specified quantities of pairs of longitudinally spaced apart paired connector openings.

Figure 15:
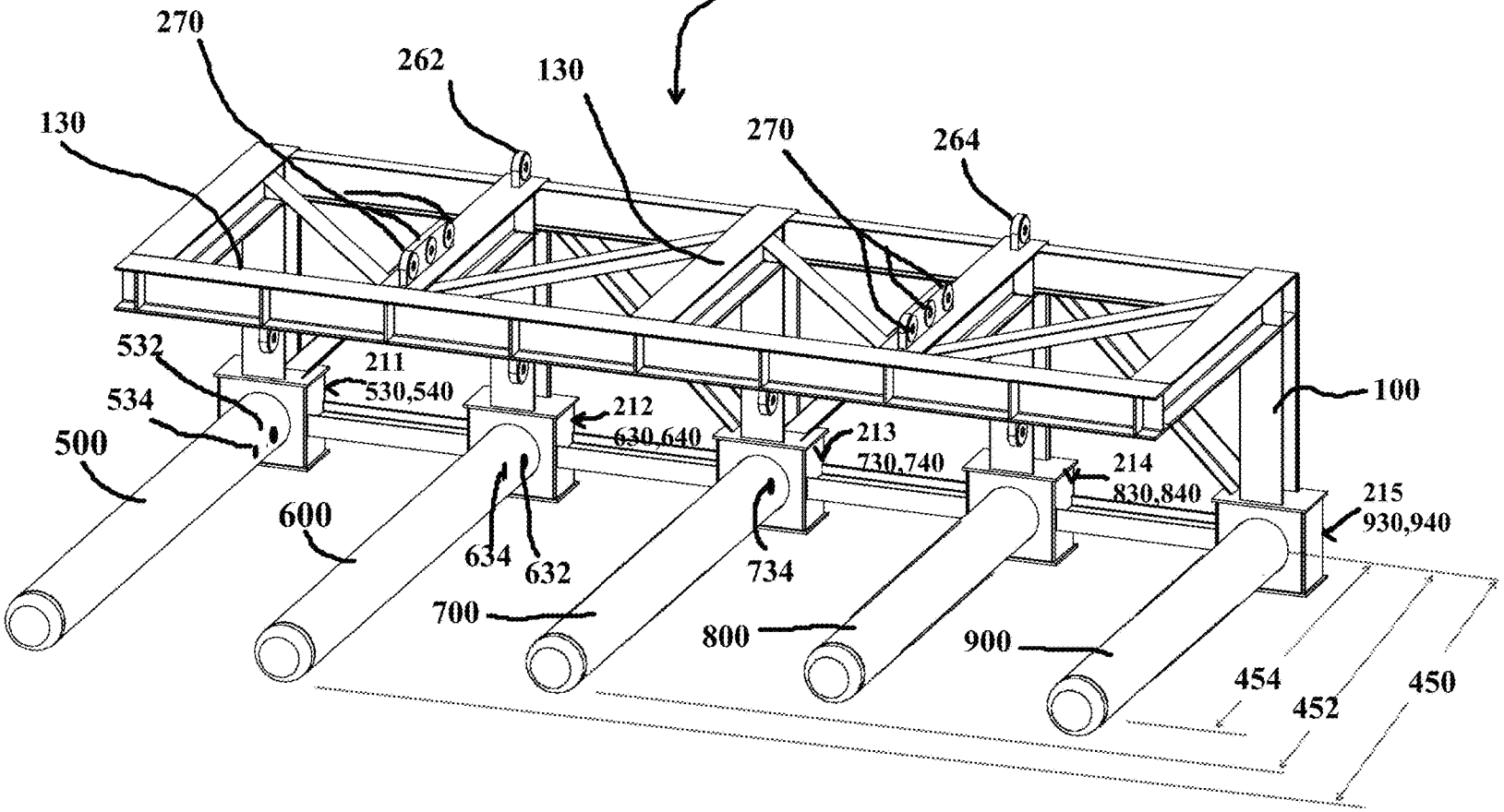
FIG. 15 is a front perspective view of the frame of FIG. 12 with a plurality of selectively adjustable lifting arms/prongs.

FIG. 15 is a front perspective view of the frame 100 with a plurality of selectively adjustable lifting arms/prongs 500, 600, 700, 800, and 900. Arms 500 and 600 are shown selectively connected to frame 100 so that their pickup length 450 is maximized (e.g., by using paired connecting openings 530, connector 540, and brackets 211 for arm/prong 500; and paired connecting openings 630, connector 640, and brackets 212 for arm/prong 600). Arm 700 has a medium pick up length 452 (by using paired connecting openings 730, connector 740, and brackets 213 for arm/prong 700). Arms 800 and 900 are shown at a shorter length 454 (e.g., by using paired connecting openings 830, connector 840, and brackets 214 for arm/prong 800 and paired connecting openings 930, connector 940, and brackets 215 for arm/prong 900). However, it is noted that any one of the paired longitudinally spaced apart connector openings of an arm could be used with the connector and brackets to obtain a selected pickup length (e.g., paired openings 532 of arm/prong 500 or paired openings 631 of arm/prong 600 could be used).

TABLE OF REFERENCE NUMERALS

The following is a table of reference numerals used in this application:

| Reference Number | Description |
|---|---|
| 10 | lifter/lifting device |
| 50 | generally horizontal plane |
| 52 | arrow in FIG. 6 showing direction of movement of unloaded lifter 10, penetrating cargo units to be lifted |
| 60 | angle of inclination |
| 100 | frame of lifter/lifting device 10 |
| 110 | first end/front of frame 100 |
| 120 | second end/rear of frame 100 |
| 130 | top section/portion of frame 100 |
| 134 | bottom section/portion of frame 100 |
| 138 | left side of frame 100 |
| 140 | right side of frame 100 |
| 150 | width of frame 100 |
| 154 | height of frame 100 |
| 160 | vertical spacing between lifting arm and top section 130 of frame 100 |
| 164 | gap between top of penetrated cargo unit and top section 130 of frame 100 |
| 201 | first frame opening |
| 202 | second frame opening |
| 203 | third frame opening |
| 204 | fourth frame opening |
| 205 | fifth frame opening |
| 211 | first pair of connecting brackets |
| 212 | second pair of connecting brackets |
| 213 | third pair of connecting brackets |
| 214 | fourth pair of connecting brackets |
| 215 | fifth pair of connecting brackets |
| 262 | first connector eyelet of first family/set of connectors |
| 264 | second connector eyelet of first family/set of connectors |
| 270 | second family/set of connectors |
| 410 | length of lifting arm extending outside of frame 100 |
| 412 | length of alternative (shorter) lifting arm extending outside of frame 100 |

-continued

| Reference Number | Description |
|---|---|
| 416 | arrow indicating adjustability of lengths 410, 412 of connecting arms/prongs |
| 420 | width presented by lifting arms |
| 422 | horizontal spacing between the respective centerlines of lifting arms 500 and 600 |
| 424 | horizontal spacing between the respective centerlines of lifting arms 600 and 700 |
| 426 | horizontal spacing between the respective centerlines of lifting arms 700 and 800 |
| 428 | horizontal spacing between the respective\centerlines of lifting arms 800 and 900 |
| 500 | first lifting arm/prong |
| 501 | cargo unit/coil of wire picked up by lifting arm |
| 502 | interior cavity of cargo unit 501 |
| 503 | cargo unit/coil of wire picked up by lifting arm |
| 504 | interior cavity of cargo unit 503 |
| 510 | first/front/free end of lifting arm 500 |
| 512 | connector eyelet extending from front end 510 of lifting arm 500 |
| 514 | longitudinal centerline of lifting arm 500 |
| 520 | second/rear end of lifting arm 500 |
| 530 | opening in lifting arm 500 for connecting pin 540 |
| 540 | removable connecting pin |
| 550 | length of first lifting arm 500 measured from its first/front end 510 to its second/rear end 520 |
| 600 | second lifting arm/prong |
| 601 | cargo unit/coil of wire picked up by lifting arm |
| 602 | interior cavity of cargo unit 601 |
| 603 | cargo unit/coil of wire picked up by lifting arm |
| 604 | interior cavity of cargo unit 603 |
| 610 | first/front/free end of lifting arm 600 |
| 612 | connector eyelet extending from front end 610 of lifting arm 600 |
| 614 | longitudinal centerline of lifting arm 600 |
| 620 | second/rear end of lifting arm 600 |
| 630 | opening in lifting arm 600 for connecting pin 640 |
| 640 | removable connecting pin |
| 650 | length of seconf lifting arm 600 measured from its first/front end 610 to its second/rear end 620 |
| 700 | third lifting arm/prong |
| 701 | cargo unit/coil of wire picked up by lifting arm |
| 702 | interior cavity of cargo unit 701 |
| 703 | cargo unit/coil of wire picked up by lifting arm |
| 704 | interior cavity of cargo unit 703 |
| 710 | first/front/free end of lifting arm 700 |
| 712 | connector eyelet extending from front end 710 of lifting arm 700 |
| 714 | longitudinal centerline of lifting arm 700 |
| 720 | second/rear end of lifting arm 700 |
| 730 | opening in lifting arm 700 for connecting pin 740 |
| 740 | removable connecting pin |
| 750 | length of third lifting arm 700 measured from its first/front end 710 to its second/rear end 720 |
| 800 | fourth lifting arm/prong |
| 801 | cargo unit/coil of wire picked up by lifting arm |
| 802 | interior cavity of cargo unit 801 |
| 803 | cargo unit/coil of wire picked up by lifting arm |
| 804 | interior cavity of cargo unit 803 |
| 810 | first/front/free end of lifting arm 800 |
| 812 | connector eyelet extending from front end 810 of lifting arm 800 |
| 814 | longitudinal centerline of lifting arm 800 |
| 820 | second/rear end of lifting arm 800 |
| 830 | opening in lifting arm 800 for connecting pin 840 |
| 840 | removable connecting pin |
| 850 | length of fourth lifting arm 800 measured from its first/front end 810 to its second/rear end 820 |
| 900 | fifth lifting arm/prong |
| 901 | cargo unit/coil of wire picked up by lifting arm |
| 902 | interior cavity of cargo unit 901 |
| 903 | cargo unit/coil of wire picked up by lifting arm |
| 904 | interior cavity of cargo unit 903 |
| 910 | first/front/free end of lifting arm 900 |
| 912 | connector eyelet extending from front end 910 of lifting arm 900 |

-continued

| Reference Number | Description |
|---|---|
| 914 | longitudinal centerline of lifting arm 900 |
| 920 | second/rear end of lifting arm 900 |
| 930 | opening in lifting arm 900 for connecting pin 940 |
| 931 | pair of longitudinally spaced paired openings |
| 932 | pair of longitudinally spaced paired openings |
| 933 | pair of longitudinally spaced paired openings |
| 934 | pair of longitudinally spaced paired openings |
| 940 | removable connecting pin |
| 950 | length of fifth lifting arm 900 measured from its first/front end 910 to its second/rear end 920 |
| 1000 | width presented by adjacent cargo units to be picked up at one time by lifter 10 |
| 1500 | crane |
| 1510 | plurality of lifting cables |
| 1520 | first set of lifting cables/supporting lines |
| 1522 | length of first set of lifting cables/supporting lines 1520 |
| 1524 | turnbuckles for first set of lifting cables 1520 |
| 1530 | second set of lifting cables/supporting lines |
| 1532 | length of second set of lifting cables/supporting lines 1530 |
| 1534 | turnbuckles for second set of lifting cables 1530 |
| 1600 | spreader bar |
| 1610 | plurality of slings |
| 2000 | plurality of wire coils |
| 2005 | wire coil cavity |
| 2010 | first row of stored wire coils 2000 |
| 2012 | horizontal spacing between centers of cavities of adjacent cargo units in first row |
| 2020 | second row of stored wire coils 2000 |
| 2030 | third row of stored wire coils 2000 |
| 2040 | fourth row of stored wire coils 2000 |
| 2900 | vessel |
| 3000 | vessel hold |
| 3100 | water |
| 3110 | water surface |
| 3160 | water surface |
| 3300 | dock |
| 3500 | barge |
| 3550 | cargo units/wire coils to be unloaded |
| 3600 | unloaded cargo units deposited on barge 3500 |
| 3650 | unloaded cargo units deposited on dock 3550 |
| 3690 | arrow showing direction of movement of lifter 10 |
| 3700 | arrow showing direction of movement of lifter 10 |
| 3702 | arrow showing direction of movement of lifter 10 |
| 3704 | arrow showing direction of movement of lifter 10 |
| 3710 | arrow showing direction of movement of lifter 10 |
| 3712 | arrow showing direction of movement of lifter 10 |
| 3720 | arrow showing direction of movement of lifter 10 |
| 3722 | arrow showing direction of movement of lifter 10 |
| 3724 | arrow showing direction of movement of lifter 10 |
| 3730 | arrow showing direction of movement of lifter 10 |
| 3732 | arrow showing direction of movement of lifter 10 |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of moving a plurality of cargo units, each of the cargo units having a cavity, comprising the steps of:

(a) providing a lifter, the lifter including:

(i) a frame with first and second ends and top and bottom portions; and (ii) at least one lifting arm having spaced apart free and second ends, wherein the second end is detachably connected to the frame at the second end of the frame;

(b) moving the lifter to a position immediately adjacent to the plurality of units of cargo;

(c) causing each free end of the at least one lifting arm to penetrate at least one cavity of the at least one cargo unit of the plurality of units of cargo;

(d) while each free end of the at least one lifting arm has penetrated the at least one cavity of the at least one cargo unit of the plurality of units of cargo, a crane raising the at least one cargo unit of the plurality of units of cargo to an elevated position, wherein the lifter and the at least one cargo unit are in free floating form;

(e) after step "d", while each free end of the at least one lifting arm has penetrated at least one cavity of the at least one cargo unit of the plurality of units of cargo and the lifter and at least one cargo unit remain in free floating form, the crane moving the lifter and the at least one cargo unit of the plurality of units of cargo to a second position which second position is laterally spaced from the position of step "b", wherein during this step "e" each free end of the at least one lifting arm is elevated compared to each second end of the at least one lifting arm; and (f) after step "e, the crane depositing the at least one cargo unit of the plurality of units of cargo at the second position by lowering the lifting unit, and after the lowering each free end of the at least one lifting arm is withdrawn from at least one cavity of the at least one cargo unit of the plurality of cargo units.

2. The method of claim 1, wherein in step "d" each free end of the at least one lifting arm is elevated compared to each second end of the at least one lifting arm such that the longitudinal axis of the at least one lifting arm forms an angle of inclination relative to a generally horizontal plane which is greater than 5 degrees.

3. The method of claim 1, wherein in step "d" each free end of the at least one lifting arm is elevated compared to each second end of the at least one lifting arm such that the longitudinal axis of the at least one lifting arm forms an angle of inclination relative to a generally horizontal plane which falls between 5 and 30 degrees.

4. The method of claim 1, wherein in step "d" the raising by the crane of the frame causes each free end of the at least one lifting arm to be elevated compared to each second end of the at least one lifting arm such that the longitudinal axis of the at least one lifting arm forms an angle of inclination relative to a generally horizontal plane which is greater than 5 degrees.

5. The method of claim 1, wherein in step "d" each of the at least one lifting arm are detachably connected to the frame of the lifter.

6. The method of claim 1, wherein in step "d" each of the at least one lifting arm include a plurality of longitudinally spaced pairs of connecting openings which provide a plurality of selectively adjustable pickup lengths for each of the at least one lifting arm.

7. The method of claim 6, wherein a ratio of pickup lengths between the shortest of the arm's selectively adjustable pickup length to the longest of the arm's selectively adjustable pickup length is selected from the following set of ratios: 0.25, 0.3, 0.4, 0.5, 0.6, 0.7, 0.75, 0.8, 0.9, 1.0.

8. The method of claim 6, wherein in step "a" the at least one lifting arm has a pickup length which is selectively adjusted from a selected first pickup length to a selected second pickup length.

9. The method of claim 6, wherein each arm includes at least two longitudinally spaced apart connection openings.

10. The method of claim 6, wherein each of the at least one lifting arm includes a plurality of longitudinally spaced apart pairs of connection openings and a connecting pin detachably connecting each arm to the frame by being inserted into one pair of the plurality of longitudinally spaced apart pairs of connection openings for the respective arm, wherein in step "a" a first arm has a pickup length which is selectively adjusted from a first selectable pickup length to a second selectable pickup length by removing the first arm's respective pin from a first pair of connection openings of the plurality of longitudinally spaced apart pairs of connection openings for the first arm, sliding the first arm relative to the frame to select a second pickup length for the first arm, and then inserting the connecting pin into a second pair of connection openings from the plurality of longitudinally spaced apart pairs of connection openings for the first arm which again detachably connects the first arm to the frame causing the first arm to have the second selectable pickup length.

11. The method of claim 10, wherein in step "a" a second arm has a pickup length which is selectively adjusted from a third selectable pickup length to a fourth selectable pickup length by removing its respective pin from a third pair of connection openings of the second arm's plurality of longitudinally spaced apart pairs of connection openings, sliding the second arm relative to the frame to select a fourth pickup length for the second arm, and then inserting the connecting pin for the second arm into a fourth pair of connection openings from the plurality of longitudinally spaced apart pairs of connection openings for the second arm which again detachably connects the second arm to the frame causing the second arm to have the fourth selectable pickup length.

12. The method of claim 11, wherein the fourth selectable pickup length for the second arm is not equal to the second selectable pickup length for the first arm.

13. The method of claim 6, wherein in step "d" at least one of the plurality of lifting arms is of a different selected pickup length than the selected pickup length of at least one other of the plurality of lifting arms.

14. The method of claim 1, wherein in step "d" at least one of the plurality of lifting arms is of a different length than at least one other of the plurality of lifting arms.

15. The method of claim 14, wherein a ratio of lengths between the shortest of the plurality of lifting arms to the longest of the plurality of lifting arms falls between 0.25 and 0.9.

16. The method of claim 1, wherein in step "a" a quantity of the at least one lifting arm detachably connected to the lifting device is selectable by a user.

17. The method of claim 16, wherein the quantity of the at least one lifting arm detachably connected to the lifting device selectable by a user falls between a range of 3 and 8.

18. The method of claim 1, wherein in step "c" the frame of the lifter is located in a hull of a vessel, and in step "e" the frame of the lifter passes over but does not touch a surface of a water.

19. The method of claim 18, wherein in step "f" the at least one cargo unit is deposited on a dock.

20. The method of claim 18, wherein in step "f" the at least one cargo unit is deposited on a barge that is not the vessel of step "c".

* * * * *